US007264579B2

(12) United States Patent
Bull

(10) Patent No.: US 7,264,579 B2
(45) Date of Patent: Sep. 4, 2007

(54) DEVICE AND METHOD FOR STRENGTHENING THE ELBOW

(76) Inventor: Brian S. Bull, 24489 Barton Rd., Loma Linda, CA (US) 92354

( * ) Notice: Subject to any disclaimer, the term of this patent is extended or adjusted under 35 U.S.C. 154(b) by 608 days.

(21) Appl. No.: 10/856,636

(22) Filed: May 27, 2004

(65) Prior Publication Data

US 2005/0079960 A1 Apr. 14, 2005

Related U.S. Application Data

(63) Continuation of application No. PCT/US03/21661, filed on Jul. 11, 2003.

(51) Int. Cl.
*A63B 21/02* (2006.01)

(52) U.S. Cl. ..... 482/121; 482/126

(58) Field of Classification Search ..... 482/44, 482/49, 91, 92, 93, 121, 122, 123, 126, 128
See application file for complete search history.

(56) References Cited

U.S. PATENT DOCUMENTS

| | | | | |
|---|---|---|---|---|
| 2,819,081 A | | 1/1958 | Touraine | 272/67 |
| 4,093,214 A | | 6/1978 | Coker et al. | 272/118 |
| 4,157,179 A | | 6/1979 | Ecklor, Jr. | |
| 4,258,913 A | | 3/1981 | Brentham | 272/67 |
| 4,402,504 A | | 9/1983 | Christian | |
| 4,492,375 A | | 1/1985 | Connelly | |
| 4,570,925 A | | 2/1986 | Kock et al. | 272/67 |
| 4,720,106 A | * | 1/1988 | Bickham | 473/521 |
| 4,826,166 A | * | 5/1989 | Baker et al. | 473/439 |
| 4,856,775 A | | 8/1989 | Colledge et al. | |
| 4,976,433 A | * | 12/1990 | Pohlenz et al. | 473/534 |
| 5,022,647 A | | 6/1991 | Fulcher | 272/117 |
| 5,060,942 A | * | 10/1991 | Dalbo | 473/215 |
| 5,088,731 A | | 2/1992 | Carpenter | |
| 5,439,225 A | * | 8/1995 | Gvoich et al. | 473/223 |
| 5,618,040 A | * | 4/1997 | Parten | 473/461 |
| 5,700,232 A | | 12/1997 | Clausen et al. | |
| 5,720,701 A | | 2/1998 | Truini | |
| 6,224,514 B1 | | 5/2001 | Price | |

FOREIGN PATENT DOCUMENTS

| | | |
|---|---|---|
| EP | 0030512 A2 | 6/1981 |
| EP | 0894513 A2 | 10/2006 |

OTHER PUBLICATIONS

Supplementary European Search Report issued in corresponding European Patent Application No. EP03818027.9.

* cited by examiner

*Primary Examiner*—Patricia Bianco
*Assistant Examiner*—Camtu Nguyen
(74) *Attorney, Agent, or Firm*—David A. Farah; Sheldon Mak Rose & Anderson PC

(57) ABSTRACT

A device and method for preventing the damage underlying lateral epicondylitis (tennis elbow) or medial epicondylitis (golfer's elbow), or both lateral epicondylitis (tennis elbow) and medial epicondylitis (golfer's elbow), or for treating the damage underlying lateral epicondylitis (tennis elbow) or medial epicondylitis (golfer's elbow), or both lateral epicondylitis (tennis elbow) and medial epicondylitis (golfer's elbow). The device comprises a central support (12), and one or more than one extension-adduction apparatus (32) or one or more than one flexion-abduction apparatus (50), or both one or more than one extension-adduction apparatus (32) and one or more than one flexion-abduction apparatus (50).

3 Claims, 20 Drawing Sheets

DEVICE AND METHOD FOR STRENGTHENING THE ELBOW

CROSS-REFERENCE TO RELATED APPLICATIONS

The present Application is a continuation PCT Patent Application PCT/US03/21661 filed Jul. 11, 2003, titled "Device and Method for Strengthening the Elbow," the contents of which are incorporated in this disclosure by reference in their entirety.

BACKGROUND

The sports of tennis and golf are regularly played by a significant portion of the population. Playing either tennis or golf involves striking a ball with a tennis racquet or golf club, respectively, gripped by the player's fingers and hand while the player's elbow joint is kept substantially extended, the player's wrist joint is kept substantially neutral, and both joints are kept substantially immobile, and while the player's upper extremity is accelerated through a shoulder motion from a flexion-abduction position to an extension-adduction position (tennis backhand) or while the player's upper extremity is accelerated through a shoulder motion from an extension-adduction position to a flexion-abduction position (typical golf swing or tennis forehand). The use of the tennis racquet or golf club greatly increases the force contacting the ball beyond the force that would be exerted if the player contacted the ball with the player's hand only and, therefore, greatly increases the counter force exerted on the player's upper extremity when the ball is struck. This unnaturally large counter force exerted on the player's upper extremity, along with the substantial immobility of the player's elbow joint and wrist joint, places considerable stress on the player's elbow joint. This considerable stress frequently damages the smaller muscles, and the tendons and other connective tissues that stabilize the player's elbow joint at the medial epicondyle and the lateral epicondyle, resulting in pain, swelling and loss of function. Such damage is referred to as "lateral epicondylitis" or "tennis elbow," and "medial epicondylitis" or "golfer's elbow "

Tennis elbow and golfer's elbow are a source of significant morbidity among tennis players and golf players, often requiring both cessation of play and affecting daily activities other than play. For professional players, tennis elbow and golfer's elbow can lead to a substantial decrease in income. Currently, the treatment of tennis elbow and golfer's elbow involves symptomatic treatment of the pain and swelling, and avoidance of playing tennis and golf, the activities that caused the damage. There are, however, no effective devices or methods for preventing the damage underlying tennis elbow and golfer's elbow. Further, there are no effective devices or methods for specifically accelerating repair of the damage underlying tennis elbow and golfer's elbow.

Therefore, there is a need for devices and methods for preventing the damage underlying tennis elbow and golfer's elbow. Further, there is a need for devices and methods that specifically repair the damage underlying tennis elbow and golfer's elbow.

SUMMARY

According to one embodiment of the present invention, there is provided a device for preventing the damage underlying lateral epicondylitis (tennis elbow) or medial epicondylitis (golfer's elbow), or both lateral epicondylitis (tennis elbow) and medial epicondylitis (golfer's elbow), or for treating the damage underlying lateral epicondylitis (tennis elbow) or medial epicondylitis (golfer's elbow), or both lateral epicondylitis (tennis elbow) and medial epicondylitis (golfer's elbow). The device comprises a central support having a proximal end, a distal end and an intermediate portion between and connected to the proximal end, one or more than one extension-adduction apparatus comprising a proximal end connected to the central support, a distal end, and a tensioner for applying tension to the distal end of the extension-adduction apparatus, and one or more than one flexion-abduction apparatus comprising a proximal end connected to the central support, a distal end, and a tensioner for applying tension to the distal end of the flexion-abduction apparatus.

According to another embodiment of the present invention, there is provided a device for preventing the damage underlying lateral epicondylitis (tennis elbow) or for treating the damage underlying lateral epicondylitis (tennis elbow). The device comprises a central support having a proximal end, a distal end and an intermediate portion between and connected to the proximal end and the distal end, and one or more than one extension-adduction apparatus comprising a proximal end connected to the central support, a distal end, and a tensioner for applying tension to the distal end of the extension-adduction apparatus.

According to another embodiment of the present invention, there is provided a device for preventing the damage underlying medial epicondylitis (golfer's elbow) or for treating the damage underlying medial epicondylitis (golfer's elbow). The device comprises a central support having a proximal end, a distal end and an intermediate portion between and connected to the proximal end and the distal end, and one or more than one flexion-abduction apparatus comprising a proximal end connected to the central support, a distal end, and a tensioner for applying tension to the distal end of the flexion-abduction apparatus.

According to another embodiment of the present invention, there is provided a device for preventing the damage underlying lateral epicondylitis (tennis elbow) or medial epicondylitis (golfer's elbow), or both lateral epicondylitis (tennis elbow) and medial epicondylitis (golfer's elbow), or for treating the damage underlying lateral epicondylitis (tennis elbow) or medial epicondylitis (golfer's elbow), or both lateral epicondylitis (tennis elbow) and medial epicondylitis (golfer's elbow). The device comprises a means for central support having a proximal end, a distal end and an intermediate portion between and connected to the proximal end and the distal end, one or more than one means for applying tension to the lateral aspect of the user's substantially extended and immobile elbow joint while the user's shoulder joint undergoes an extension-adduction movement comprising a proximal end connected to the means for central support, a distal end, and a tensioner means for applying tension to the distal end of the means for applying tension to the lateral aspect of the user's substantially extended and immobile elbow joint while the user's shoulder joint undergoes an extension-adduction movement, and one or more than one means for applying tension to the medial aspect of the user's substantially extended and immobile elbow joint while the user's shoulder joint undergoes a flexion-abduction movement comprising a proximal end connected to the means for central support, a distal end, and a tensioner means for applying tension to the distal end of the means for applying tension to the medial aspect of the user's substantially extended and immobile elbow joint while the user's shoulder joint undergoes a flexion-abduction movement.

According to another embodiment of the present invention, there is provided a device for preventing the damage underlying lateral epicondylitis (tennis elbow) or for treating the damage underlying lateral epicondylitis (tennis elbow). The device comprises a means for central support having a proximal end, a distal end and an intermediate portion between and connected to the proximal end and the distal end, and one or more than one means for applying tension to the lateral aspect of the user's substantially extended and immobile elbow joint while the user's shoulder joint undergoes an extension-adduction movement comprising a proximal end connected to the means for central support, a distal end, and a tensioner means for applying tension to the distal end of the means for applying tension to the lateral aspect of the user's substantially extended and immobile elbow joint while the user's shoulder joint undergoes an extension-adduction movement.

According to another embodiment of the present invention, there is provided a device for preventing the damage underlying medial epicondylitis (golfer's elbow) or for treating the damage underlying medial epicondylitis (golfer's elbow). The device comprises a means for central support having a proximal end, a distal end and an intermediate portion between and connected to the proximal end and the distal end, and one or more than one means for applying tension to the medial aspect of the user's substantially extended and immobile elbow joint while the user's shoulder joint undergoes a flexion-abduction movement comprising a proximal end connected to the means for central support, a distal end, and a tensioner means for applying tension to the distal end of the means for applying tension to the medial aspect of the user's substantially extended and immobile elbow joint while the user's shoulder joint undergoes a flexion-abduction movement.

In one embodiment, the central support, or the means for central support, is selected from the group consisting of a rigid bar, a rigid tube, and a rigid, inverted "Y" shaped structure having a single bar proximally, dividing into two bars distally. In another embodiment, the intermediate portion of the central support, or the means for central support, comprises a rigid rim surrounding a central opening. In another embodiment, the central support, or the means for central support, has an axial length of between about 25 cm and about 150 cm. In another embodiment, the proximal end of the central support, or the means for central support, comprises a grip.

In another embodiment, the distal end of the central support, or the means for central support, comprises a stabilizer or a stabilizing means. In another embodiment, the stabilizer, or a stabilizing means, comprises a flat distal surface. In another embodiment, the stabilizer, or the stabilizing means, comprises a plate that has been molded to be convex.

In another embodiment, the extension-adduction apparatus, or the means for applying tension to the lateral aspect of the user's substantially extended and immobile elbow joint while the user's shoulder joint undergoes an extension-adduction movement, further comprises a handle at the distal end of the extension-adduction apparatus. In another embodiment, the tensioner of the extension-adduction apparatus, or the means for applying tension to the lateral aspect of the user's substantially extended and immobile elbow joint while the user's shoulder joint undergoes an extension-adduction movement, comprises an elastic cord or spring connected to the central support, or the means for central support, proximally and connected to a handle distally. In another embodiment, the tensioner of the extension-adduction apparatus, or the means for applying tension to the lateral aspect of the user's substantially extended and immobile elbow joint while the user's shoulder joint undergoes an extension-adduction movement, comprises a lever. In another embodiment, the lever comprises a rigid "L" shaped structure and a rigid strut.

In another embodiment, the flexion-abduction apparatus, or the means for applying tension to the medial aspect of the user's substantially extended and immobile elbow joint while the user's shoulder joint undergoes a flexion-abduction movement, further comprises a handle at the distal end of the flexion-abduction apparatus. In another embodiment, the tensioner of the flexion-abduction apparatus, or the tensioner means of the means for applying tension to the medial aspect of the user's substantially extended and immobile elbow joint while the user's shoulder joint undergoes a flexion-abduction movement, comprises a strut and comprises an elastic cord or spring connected to the central support, or the means for central support, proximally and connected to a handle distally. In another embodiment, the tensioner of the flexion-abduction apparatus, or the tensioner means of the means for applying tension to the medial aspect of the user's substantially extended and immobile elbow joint while the user's shoulder joint undergoes a flexion-abduction movement, comprises a lever. In another embodiment, the lever comprises a rigid "L" shaped structure and a rigid strut.

In another embodiment, the extension-adduction apparatus and the flexion-abduction apparatus are the same apparatus. In another embodiment, the extension-adduction apparatus and the flexion-abduction apparatus are different apparatuses.

In another embodiment, the means for applying tension to the lateral aspect of the user's substantially extended and immobile elbow joint while the user's shoulder joint undergoes an extension-adduction movement and the means for applying tension to the medial aspect of the user's substantially extended and immobile elbow joint while the user's shoulder joint undergoes a flexion-abduction movement, is the same apparatus. In another embodiment, the means for applying tension to the lateral aspect of the user's substantially extended and immobile elbow joint while the user's shoulder joint undergoes an extension-adduction movement and the means for applying tension to the medial aspect of the user's substantially extended and immobile elbow joint while the user's shoulder joint undergoes a flexion-abduction movement are different apparatuses.

In another embodiment, of the present invention there is provided a method for preventing the damage underlying lateral epicondylitis (tennis elbow) to a user's elbow on the user's first side, or for treating a user's elbow for lateral epicondylitis (tennis elbow) on the user's first side, the method comprising: a) providing a device according to the present invention, b) stabilizing the central axis of the device substantially parallel to the long axis of the user's trunk, c) engaging the distal end of the extension-adduction apparatus, d) pulling the distal end of the extension-adduction apparatus away from the central support, or the means for central support, while keeping the user's elbow joint on the first side substantially extended and immobile, and while the user's shoulder joint on the first side undergoes an extension-adduction movement, e) allowing the distal end of the extension-adduction apparatus to return toward the central support, or the means for central support, and f) repeating d) and e) a plurality of times.

In another embodiment, there is provided a method for preventing the damage underlying medial epicondylitis (golfer's elbow) to a user's elbow on the user's first side, or for treating a user's elbow for medial epicondylitis (golfer's elbow) on the user's first side, the method comprising: a) providing a device according to the present invention, b) stabilizing the central axis of the device substantially parallel to the long axis of the user's trunk, c) engaging the distal end of the flexion-abduction apparatus, d) pushing the distal end of the flexion-abduction apparatus toward the central support, or the means for central support, while keeping the user's elbow joint on the first side substantially extended and immobile, and while the user's shoulder joint on the first side undergoes a flexion-abduction movement, e) allowing the distal end of the flexion-abduction apparatus to return toward the central support, or the means for central support, and f) repeating d) and e) a plurality of times.

In another embodiment, there is provided a method for preventing the damage underlying both lateral epicondylitis (tennis elbow) and medial epicondylitis (golfer's elbow) to a user's elbow on the user's first side, or for treating a user's elbow for both lateral epicondylitis (tennis elbow) and medial epicondylitis (golfer's elbow) on the user's first side, or for both preventing the damage underlying both lateral epicondylitis (tennis elbow) and medial epicondylitis (golfer's elbow) to a user's elbow on the user's first side, and for treating a user's elbow for both lateral epicondylitis (tennis elbow) and medial epicondylitis (golfer's elbow) on the user'ms first side, the method comprising: a) providing a device according to the present invention, b) stabilizing the central axis of the device substantially parallel to the long axis of the user's trunk, c) engaging the distal end of the extension-adduction apparatus, d) pulling the distal end of the extension-adduction apparatus away from the central support, or the means for central support, while keeping the user's elbow joint on the first side substantially extended and immobile, and while the user's shoulder joint on the first side undergoes an extension-adduction movement, e) allowing the distal end of the extension-adduction apparatus to return toward the central support, or the means for central support, f) repeating d) and e) a plurality of times, g) engaging the distal end of the flexion-abduction apparatus, h) pushing the distal end of the flexion-abduction apparatus toward the central support, or the means for central support, while keeping the user's elbow joint on the first side substantially extended and immobile, and while the user's shoulder joint on the first side undergoes a flexion-abduction movement, i) allowing the distal end of the flexion-abduction apparatus to return away from the central support, or the means for central support, and j) repeating h) and i) a plurality of times, where c) through f) can come before or after g) through j).

In another embodiment, there is provided a method for preventing the damage underlying lateral epicondylitis (tennis elbow) to a user's elbow on the user's first side, or for treating a user's elbow for lateral epicondylitis (tennis elbow) on the user's first side, the method comprising: a) providing a device according to the present invention, b) stabilizing the central axis of the device substantially parallel to the long axis of the user's trunk, c) engaging the distal end of the means for applying tension to the lateral aspect of the user's substantially extended and immobile elbow joint while the user's shoulder joint undergoes an extension-adduction movement, d) pulling the distal end of the means for applying tension to the lateral aspect of the user's substantially extended and immobile elbow joint while the user's shoulder joint undergoes an extension-adduction movement away from the means for central support while keeping the user's elbow joint on the first side substantially extended and immobile, and while the user's shoulder joint on the first side undergoes an extension-adduction movement, e) allowing the distal end of the means for applying tension to the lateral aspect of the user's substantially extended and immobile elbow joint while the user's shoulder joint undergoes an extension-adduction movement to return toward the means for central support, and f) repeating d) and e) a plurality of times.

In another embodiment, there is provided a method for preventing the damage underlying medial epicondylitis (golfer's elbow) to a user's elbow on the user's first side, or for treating a user's elbow for medial epicondylitis (golfer's elbow) on the user's first side, the method comprising: a) providing a device according to the present invention, b) stabilizing the central axis of the device substantially parallel to the long axis of the user's trunk, c) engaging the distal end of the means for applying tension to the medial aspect of the user's substantially extended and immobile elbow joint while the user's shoulder joint undergoes a flexion-abduction movement, d) pushing the distal end of the means for applying tension to the medial aspect of the user's substantially extended and immobile elbow joint while the user's shoulder joint undergoes a flexion-abduction movement toward the means for central support while keeping the user's elbow joint on the first side substantially extended and immobile, and while the user's shoulder joint on the first side undergoes a flexion-abduction movement, e) allowing the distal end of the means for applying tension to the lateral aspect of the user's substantially extended and immobile elbow joint while the user's shoulder joint undergoes an extension-adduction movement to return toward the means for central support, and f) repeating d) and e) a plurality of times.

In another embodiment, there is provided a method for preventing the damage underlying both lateral epicondylitis (tennis elbow) and medial epicondylitis (golfer's elbow) to a user's elbow on the user's first side, or for treating a user's elbow for both lateral epicondylitis (tennis elbow) and medial epicondylitis (golfer's elbow) on the user's first side, or for both preventing the damage underlying both lateral epicondylitis (tennis elbow) and medial epicondylitis (golfer's elbow) to a user's elbow on the user's first side, and for treating a user's elbow for both lateral epicondylitis (tennis elbow) and medial epicondylitis (golfer's elbow) on the user's first side, the method comprising: a) providing a device according to the present invention, b) stabilizing the central axis of the device substantially parallel to the long axis of the user's trunk, c) engaging the distal end of the means for applying tension to the lateral aspect of the user's substantially extended and immobile elbow joint while the user's shoulder joint undergoes an extension-adduction movement, d) pulling the distal end of the means for applying tension to the lateral aspect of the user's substantially extended and immobile elbow joint while the user's shoulder joint undergoes an extension-adduction movement away from the means for central support while keeping the user's elbow joint on the first side substantially extended and immobile, and while the user's shoulder joint on the first side undergoes an extension-adduction movement, e) allowing the distal end of the means for applying tension to the lateral aspect of the user's substantially extended and immobile elbow joint while the user's shoulder joint undergoes an extension-adduction movement to return toward the means for central support, f) repeating d) and e) a plurality of times, g) engaging the distal end of the means for applying tension to the medial aspect of the user's substantially extended and immobile elbow joint while the user's shoulder joint undergoes a flexion-abduction movement, h) pushing the distal end of the means for applying tension to the medial aspect of the user's substantially extended and immobile elbow joint while the user's shoulder joint undergoes a flexion-abduction movement toward the means for central support while keeping the user's elbow joint on the first side substantially extended and immobile, and while the user's shoulder joint on the first side undergoes a flexion-abduction movement, i) allowing the distal end of the means for applying tension to the medial aspect of the user's substantially extended and immobile elbow joint while the user's shoulder joint undergoes an extension-adduction movement to return away from the means for central support, and j) repeating h) and i) a plurality of times, where c) through f) can come before or after g) through j).

In another embodiment, stabilizing the central axis of the device substantially parallel to the long axis of the user's trunk comprises grasping the proximal end of the device with the user's hand on the user's second side. In another embodiment, stabilizing the central axis of the device substantially parallel to the long axis of the user's trunk comprises resting the distal end of the device on the user's distal anterior thigh adjacent the user's knee cap or to the anterior aspect of the user's knee or both of the user's second side.

FIGURES

These and other features, aspects and advantages of the present invention will become better understood with regard to the following description, appended claims, and accompanying figures where:

Figure 1:
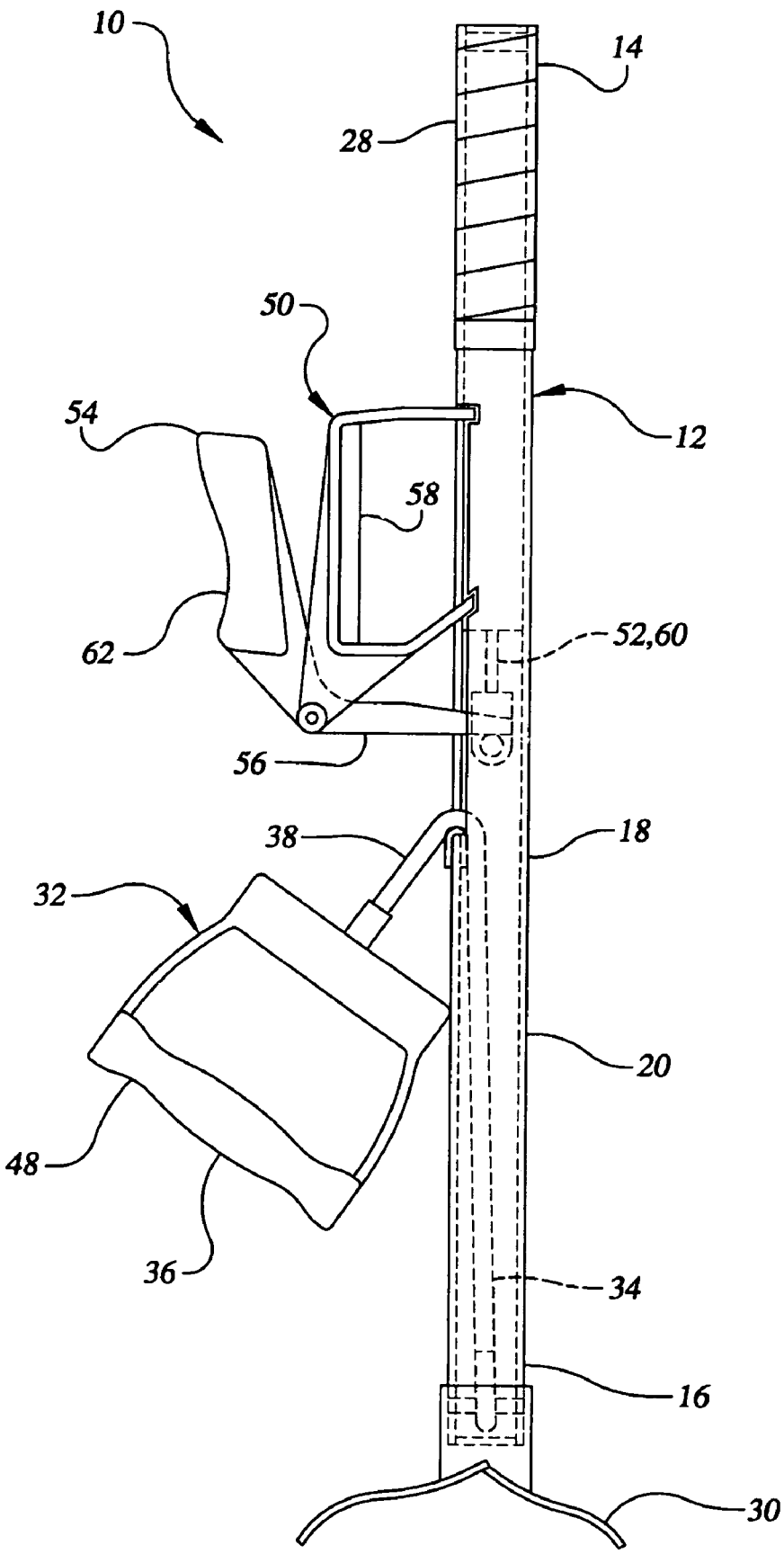
FIG. 1 is an elevational perspective view of one embodiment of the device according to the present invention.
Figure 2:
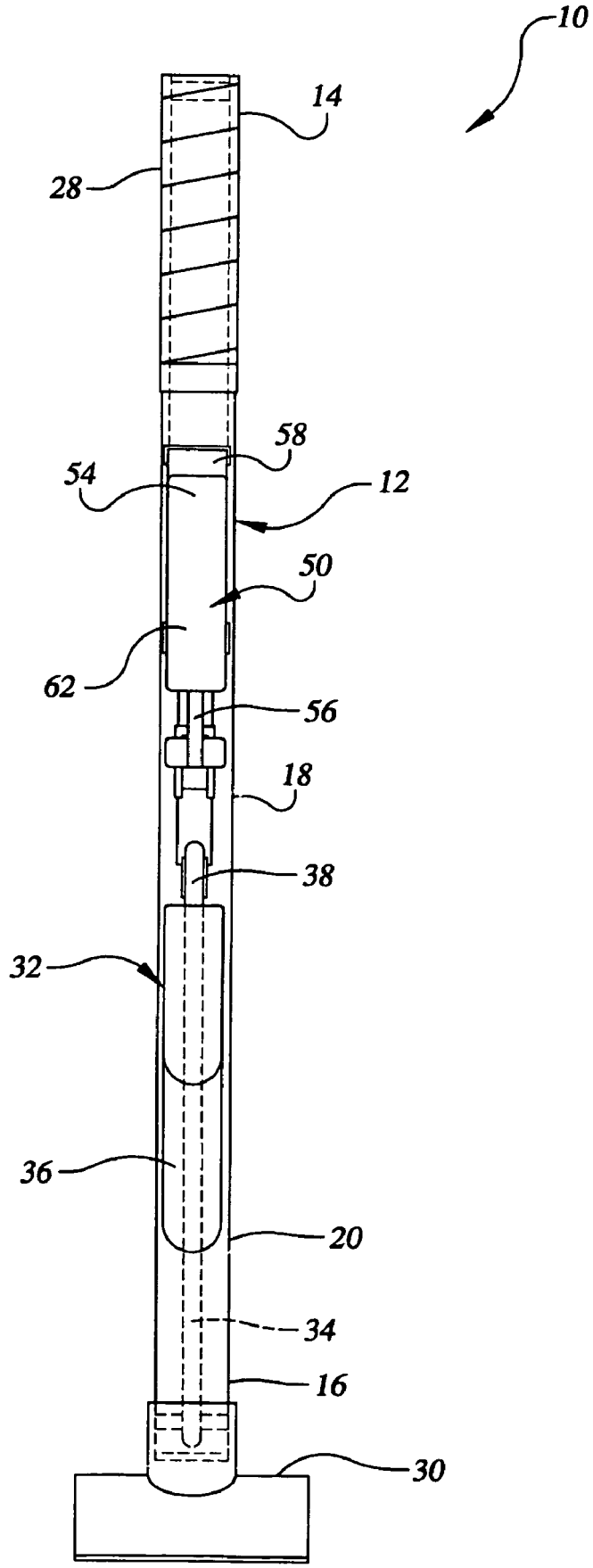
FIG. 2 is an elevational perspective view of the embodiment of the device shown in FIG. 1, axially rotated 90° from the view shown in FIG. 1.
Figure 3:
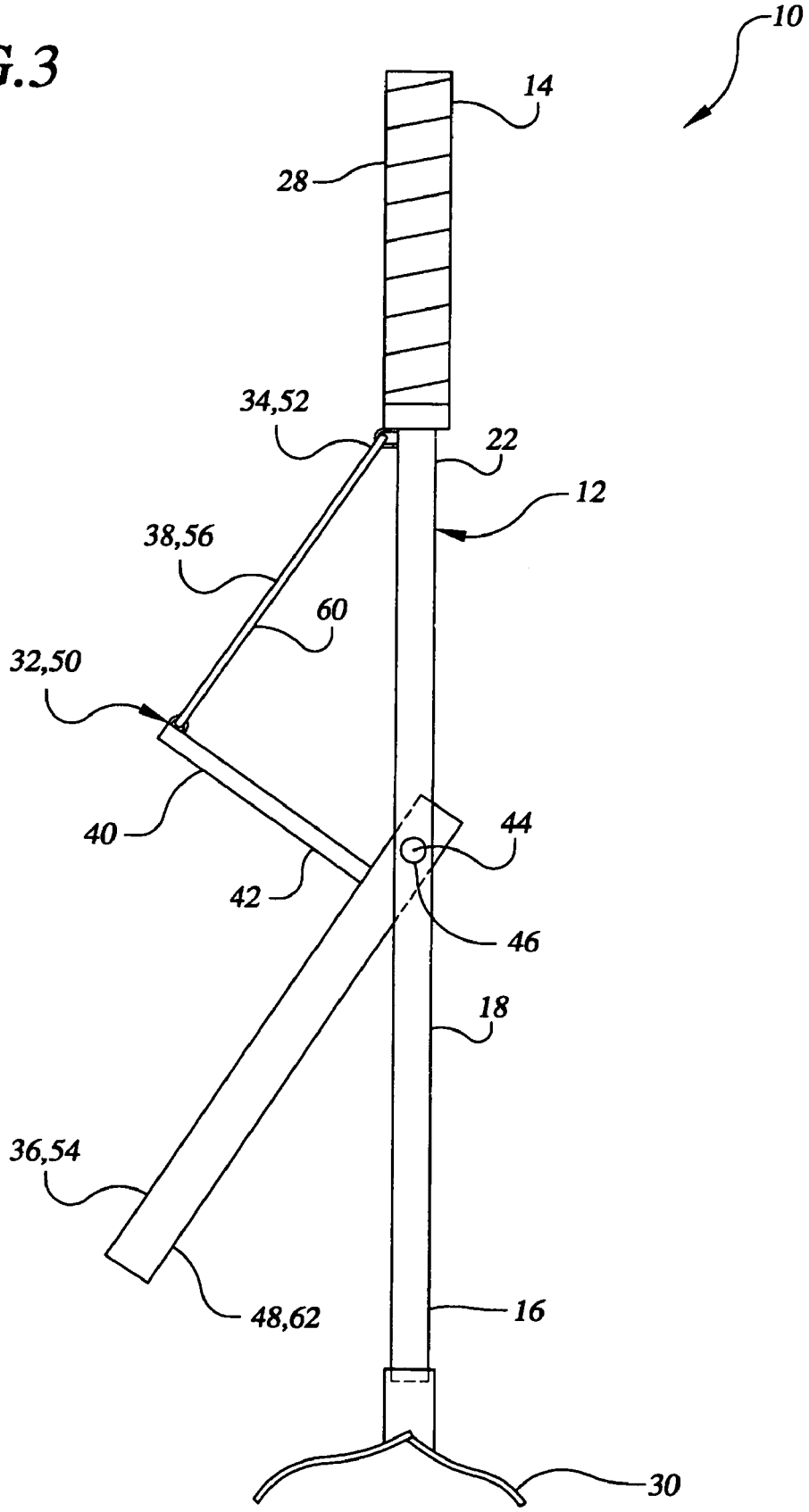
FIG. 3 is an elevational perspective view of another embodiment of the device according to the present invention.
Figure 4:
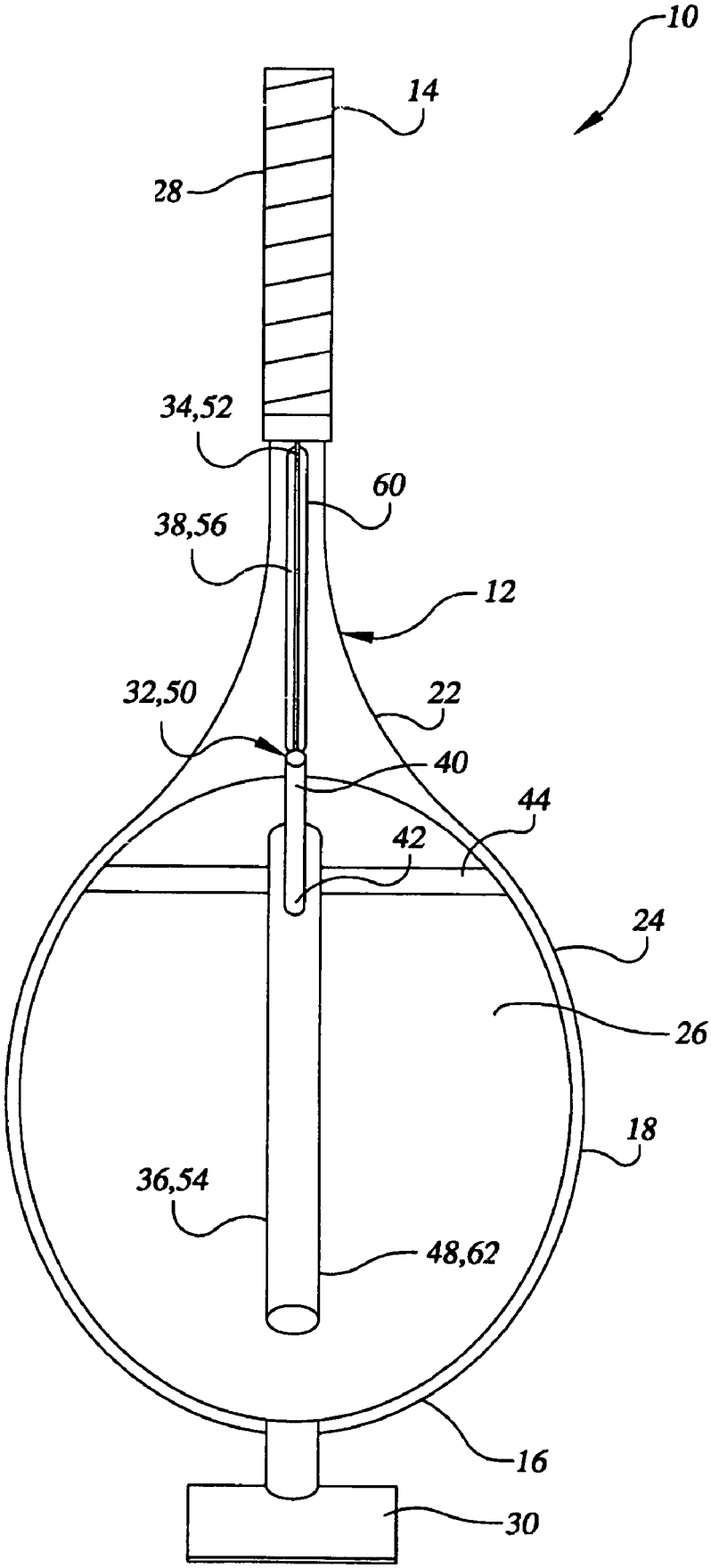
FIG. 4 is an elevational perspective view of the embodiment of the device shown in FIG. 1, axially rotated 90° from the view shown in FIG. 3.
Figure 10:
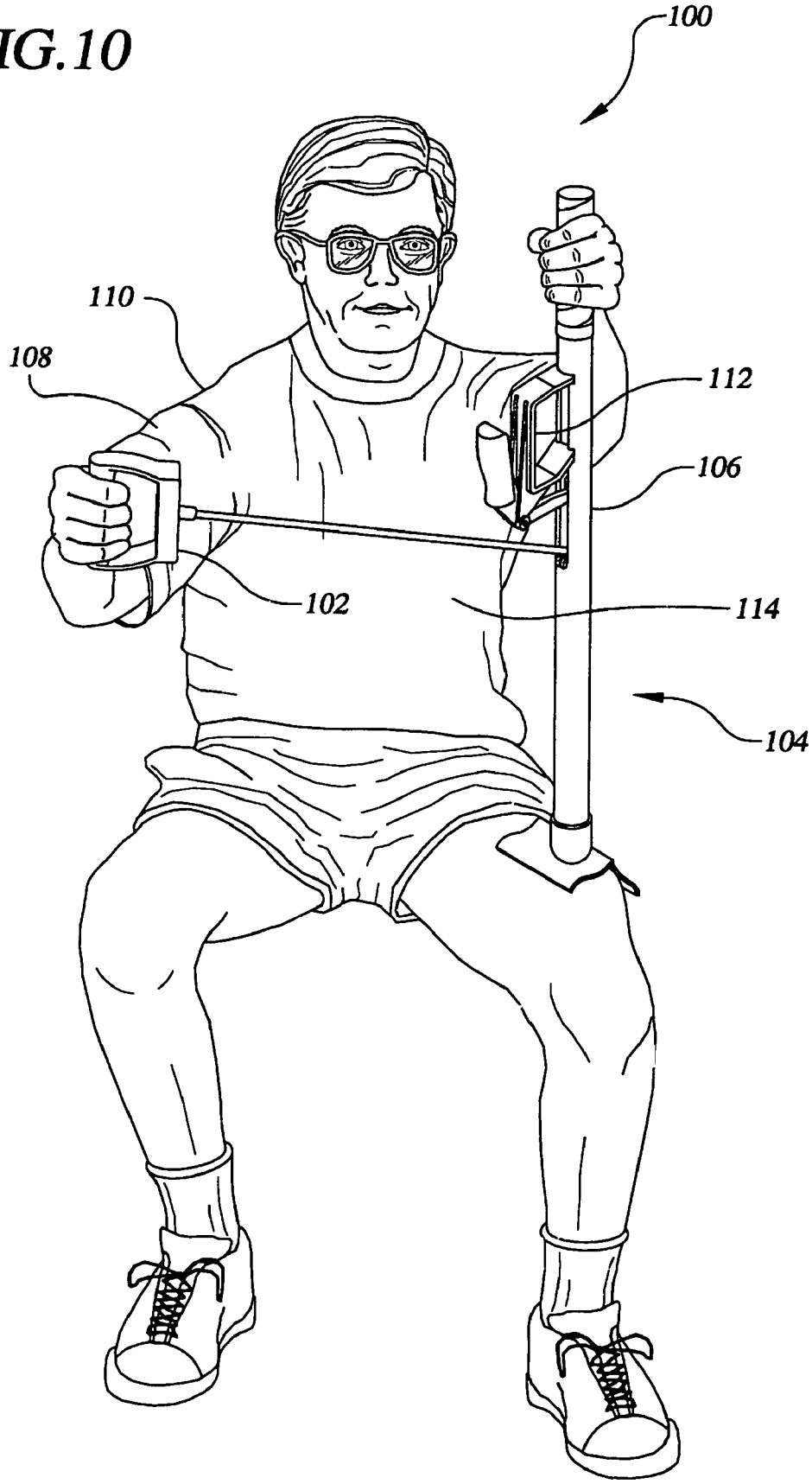
Figure 11:
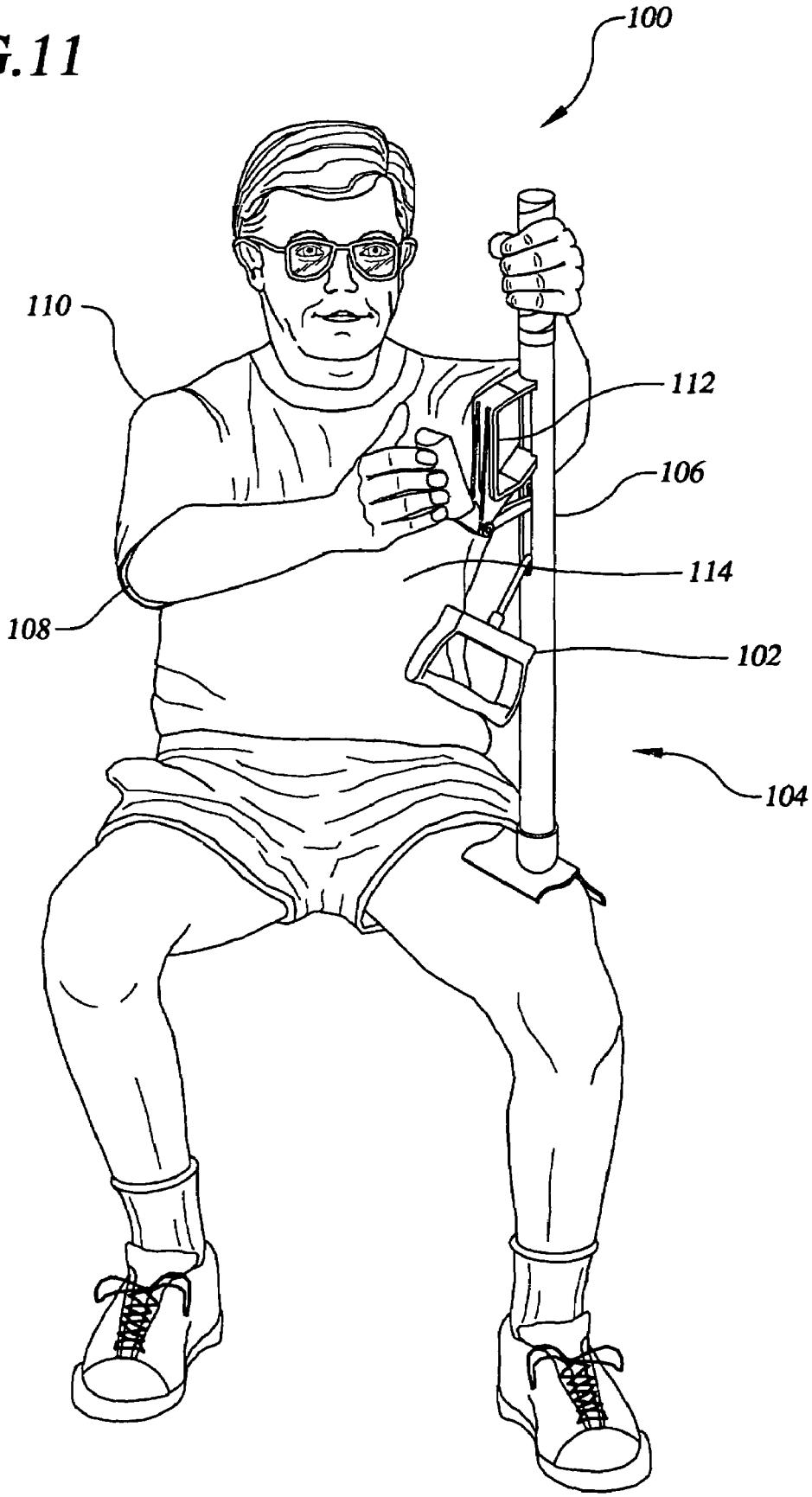
Figure 12:
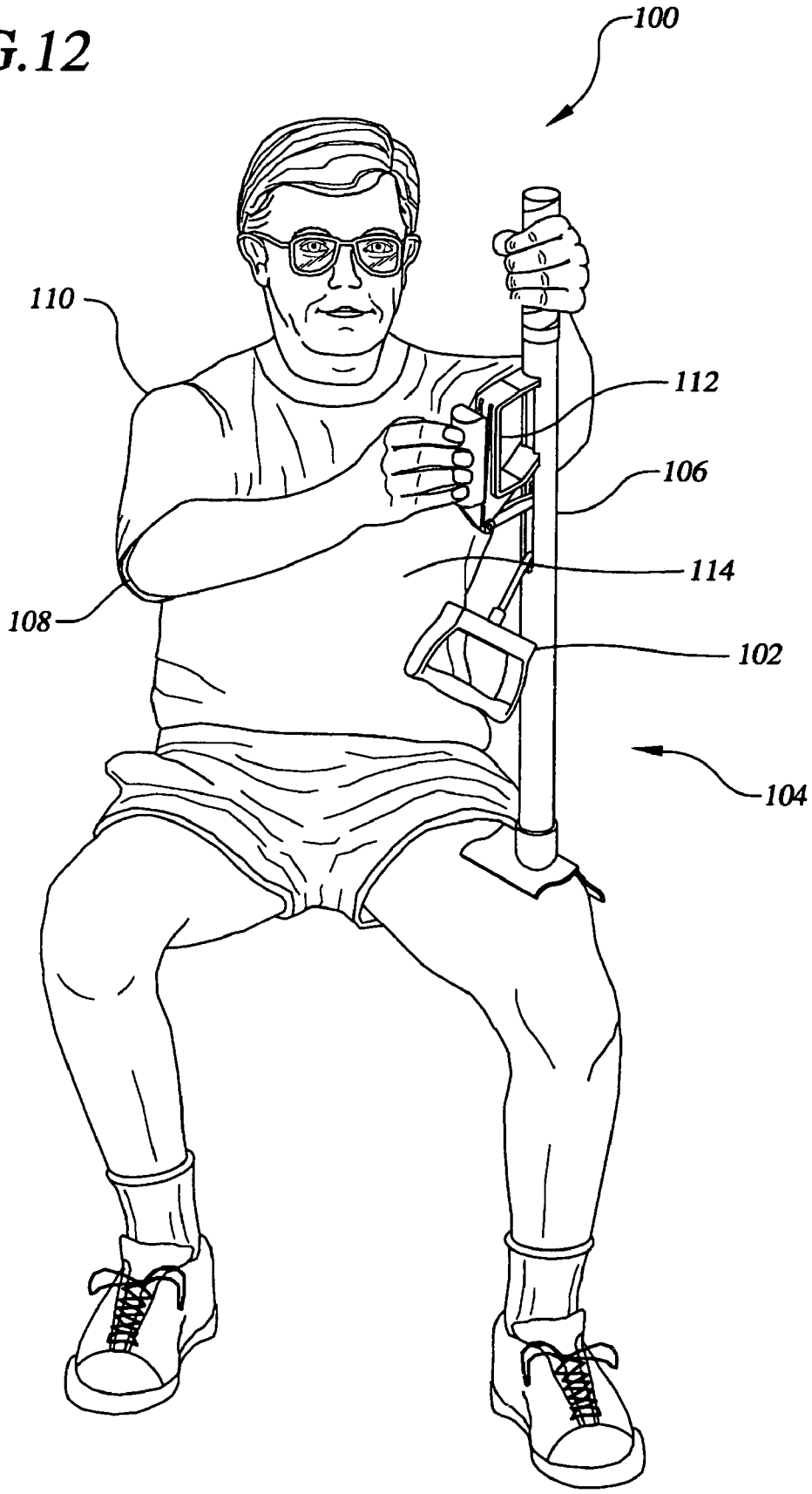
Figure 13:
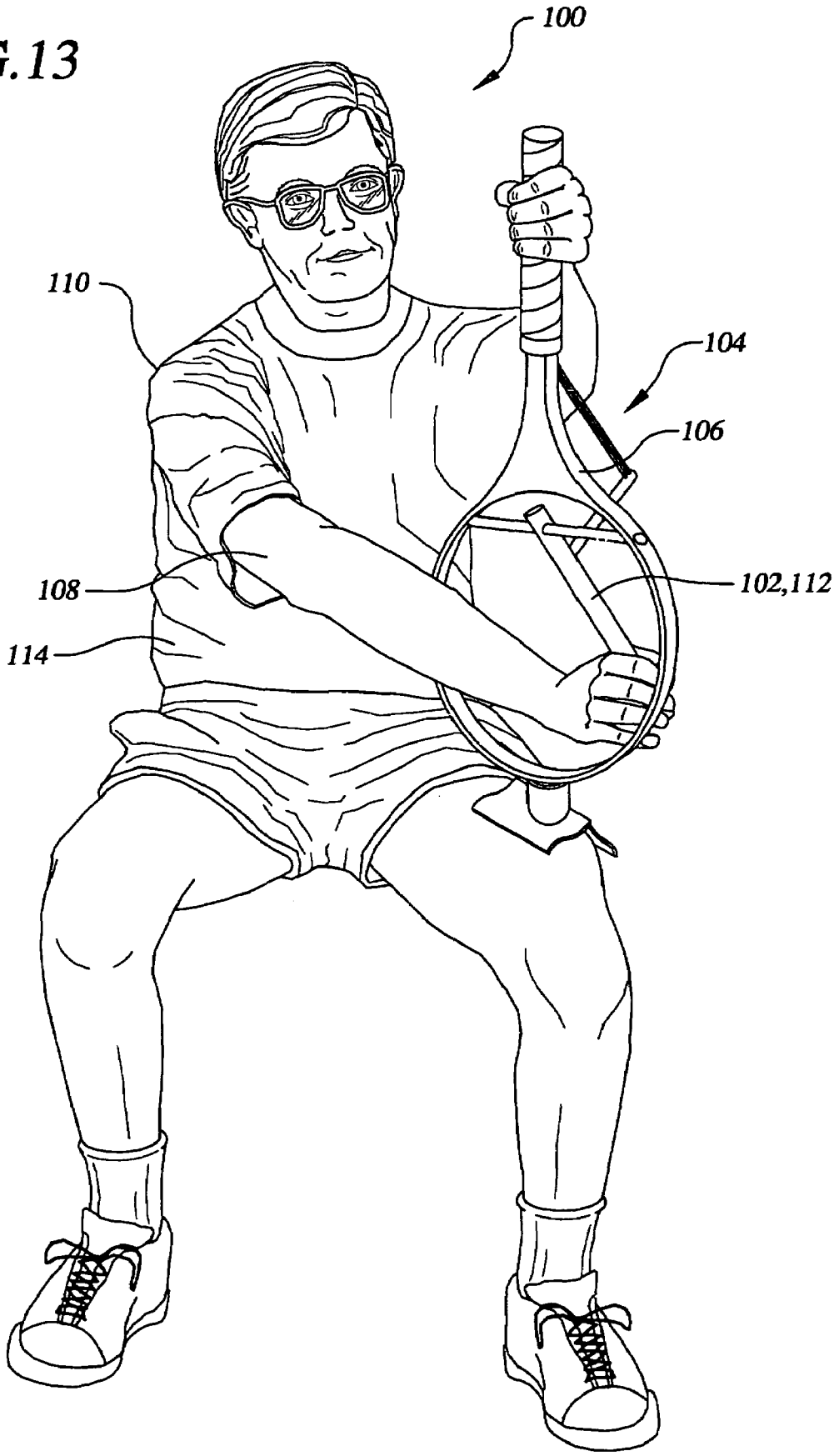
Figure 14:
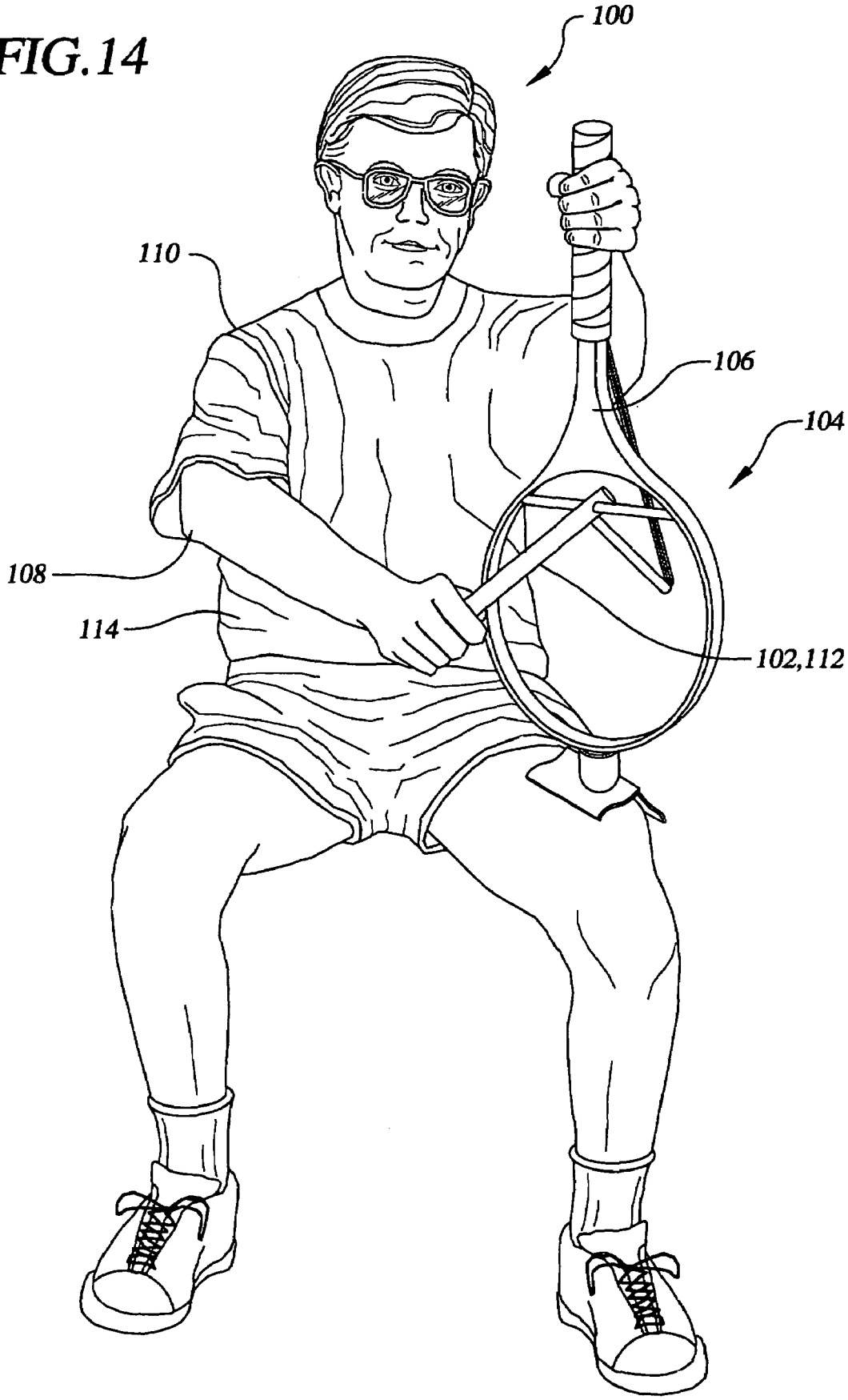
Figure 15:
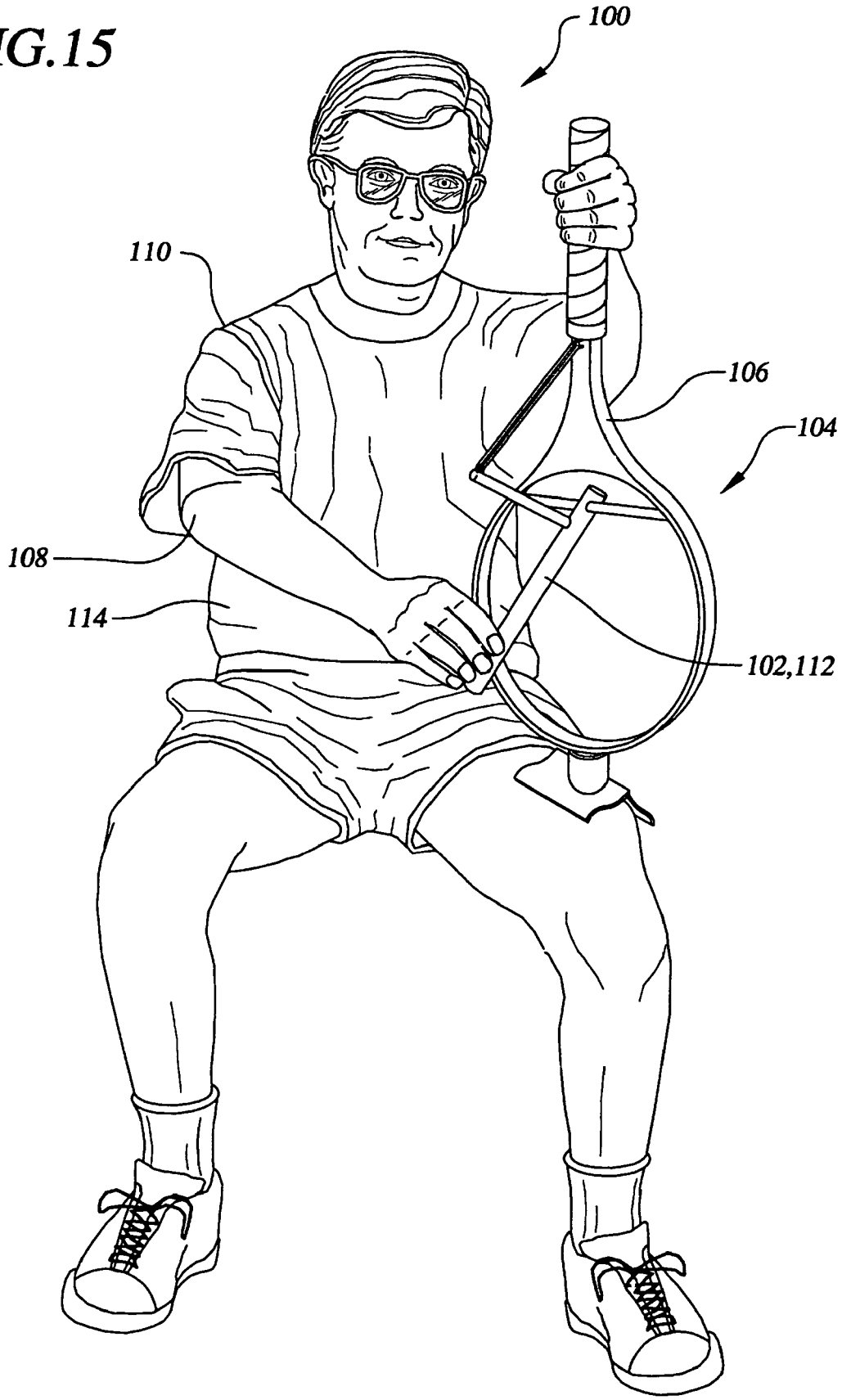

FIG. 10 is a front perspective view of the user pulling the distal end of the extension-adduction apparatus, or the means for applying tension to the lateral aspect of the user's substantially extended and immobile elbow joint while the user's shoulder joint undergoes an extension-adduction movement, of the device shown in FIG. 1 and FIG. 2, away from the central support while keeping the user's elbow joint on the first side substantially extended and immobile, and while the user's shoulder joint on the first side undergoes an extension-adduction movement;

FIG. 11 is a front perspective view of the user engaging the distal end of the flexion-abduction apparatus, or engaging the means for applying tension to the medial aspect of the user's substantially extended and immobile elbow joint while the user's shoulder joint undergoes a flexion-abduction movement, of the device shown in FIG. 1 and FIG. 2;

FIG. 12 is a front perspective view of the user pushing the distal end of the flexion-abduction apparatus, or the means for applying tension to the medial aspect of the user's substantially extended and immobile elbow joint while the user's shoulder joint undergoes a flexion-abduction movement, of the device shown in FIG. 1 and FIG. 2, toward the central support while keeping the user's elbow joint on the first side substantially extended and immobile, and while the user's shoulder joint on the first side undergoes a flexion-abduction movement FIG. 13 is a front perspective view of a user engaging the distal end of the extension-adduction apparatus, or engaging the means for applying tension to the lateral aspect of the user's substantially extended and immobile elbow joint while the user's shoulder joint undergoes an extension-adduction movement, of the device shown in FIG. 3 and FIG. 4;

FIG. 14 is a front perspective view of the user pulling the distal end of the extension-adduction apparatus, or the means for applying tension to the lateral aspect of the user's substantially extended and immobile elbow joint while the user's shoulder joint undergoes an extension-adduction movement, of the device shown in FIG. 3 and FIG. 4, away from the central support while keeping the user's elbow joint on the first side substantially extended and immobile, and while the user's shoulder joint on the first side undergoes an extension-adduction movement FIG. 15 is a front perspective view of the user engaging the distal end of the flexion-abduction apparatus, or engaging the means for applying tension to the medial aspect of the user's substantially extended and immobile elbow joint while the user's shoulder joint undergoes a flexion-abduction movement, of the device shown in FIG. 3 and FIG. 4

Figure 5:
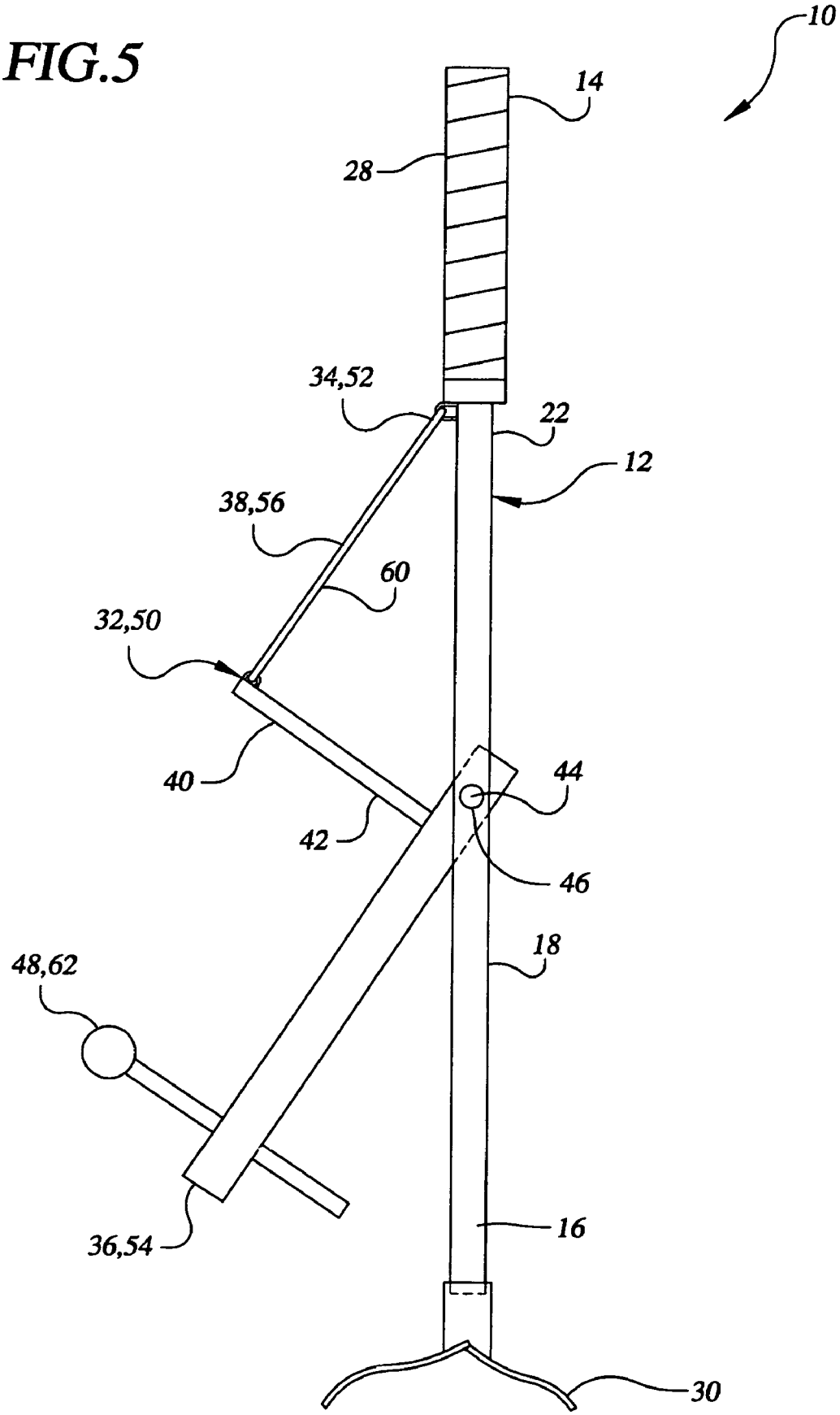
FIG. 5 is an elevational perspective view of the distal end of a variation of the embodiment of the device shown in FIG. 3.
Figure 6:
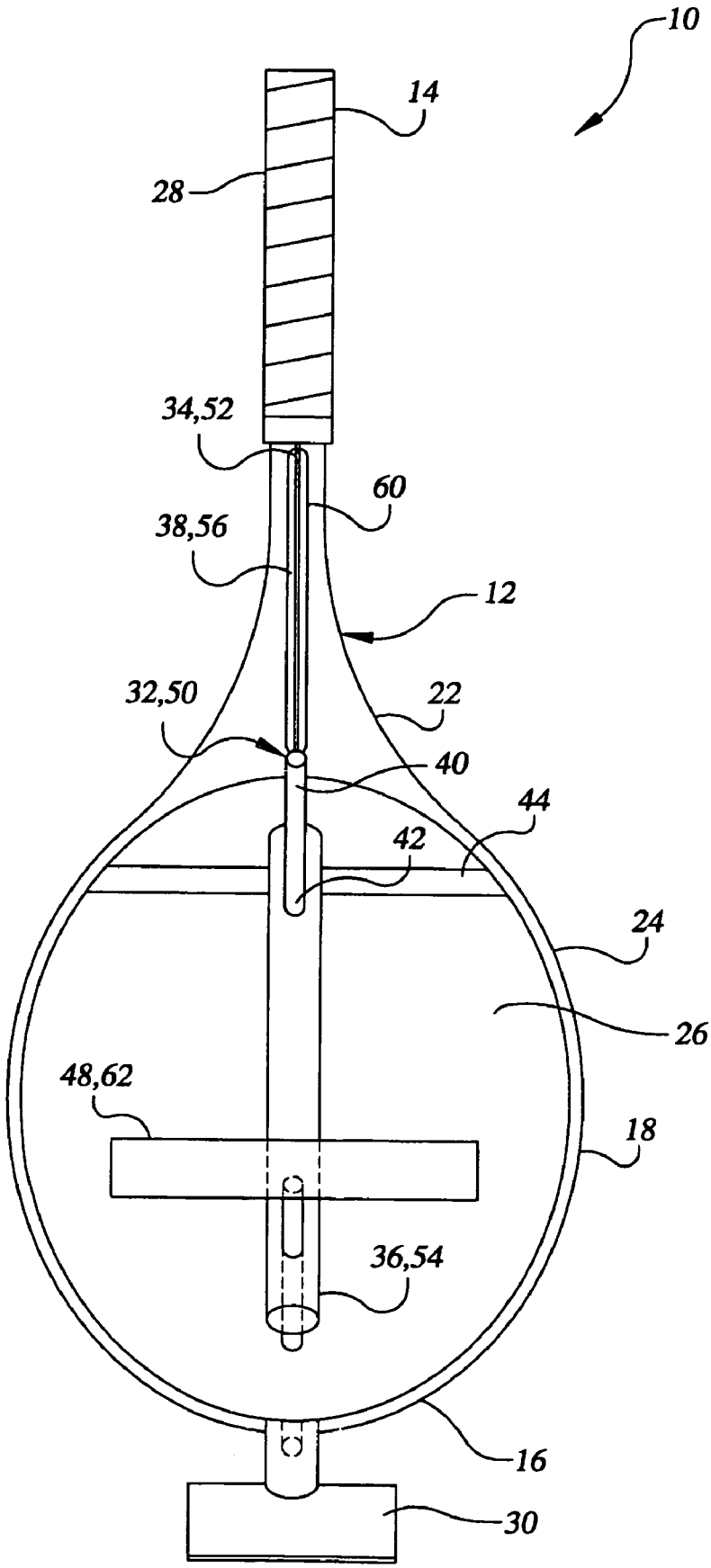
FIG. 6 is an elevational perspective view of the embodiment of the device shown in FIG. 5, axially rotated 90° from the view shown in FIG. 5.
Figure 7:
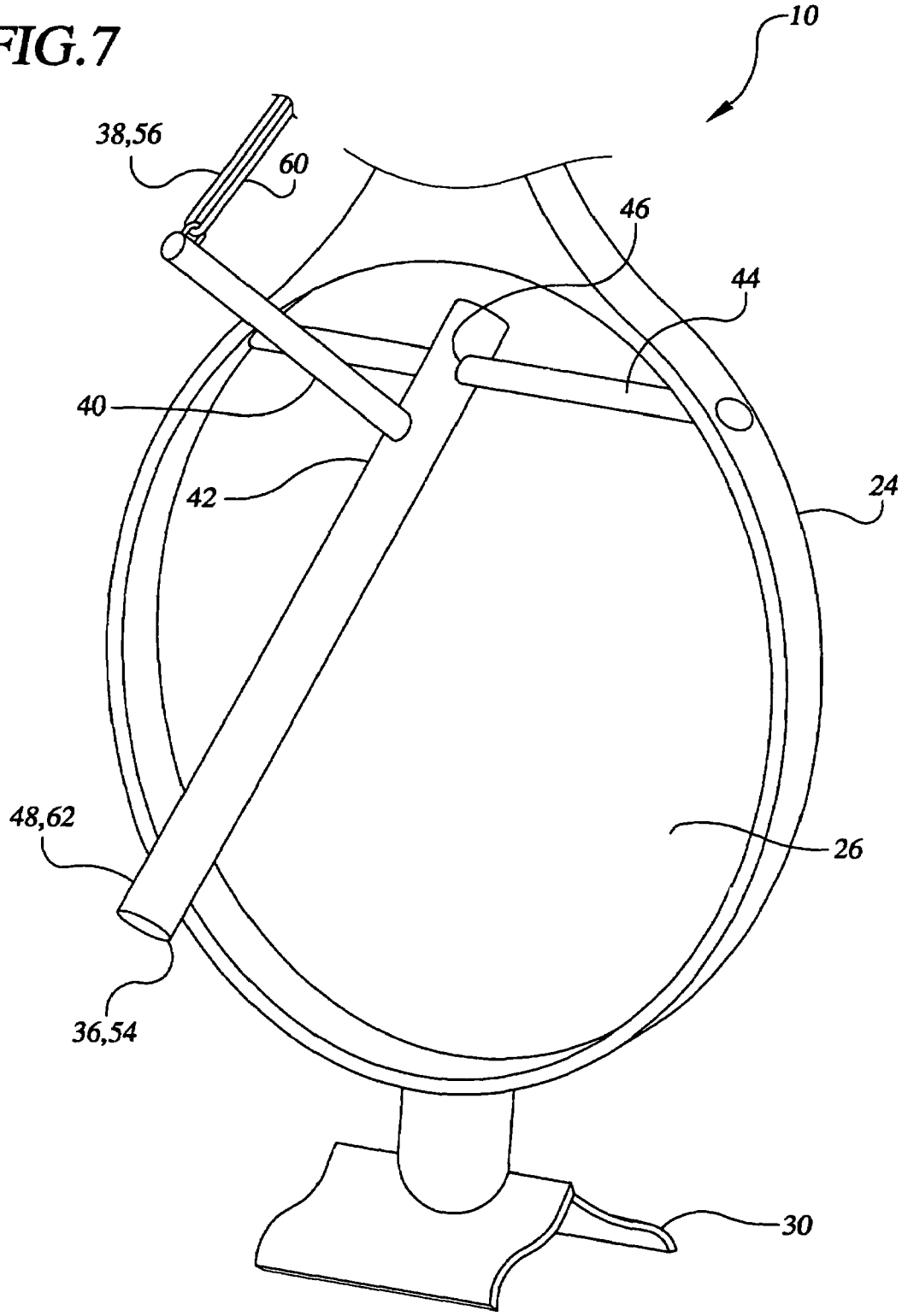
FIG. 7 is an elevational perspective view of the distal end of a variation of the embodiment of the device shown in FIG. 3.
Figure 16:
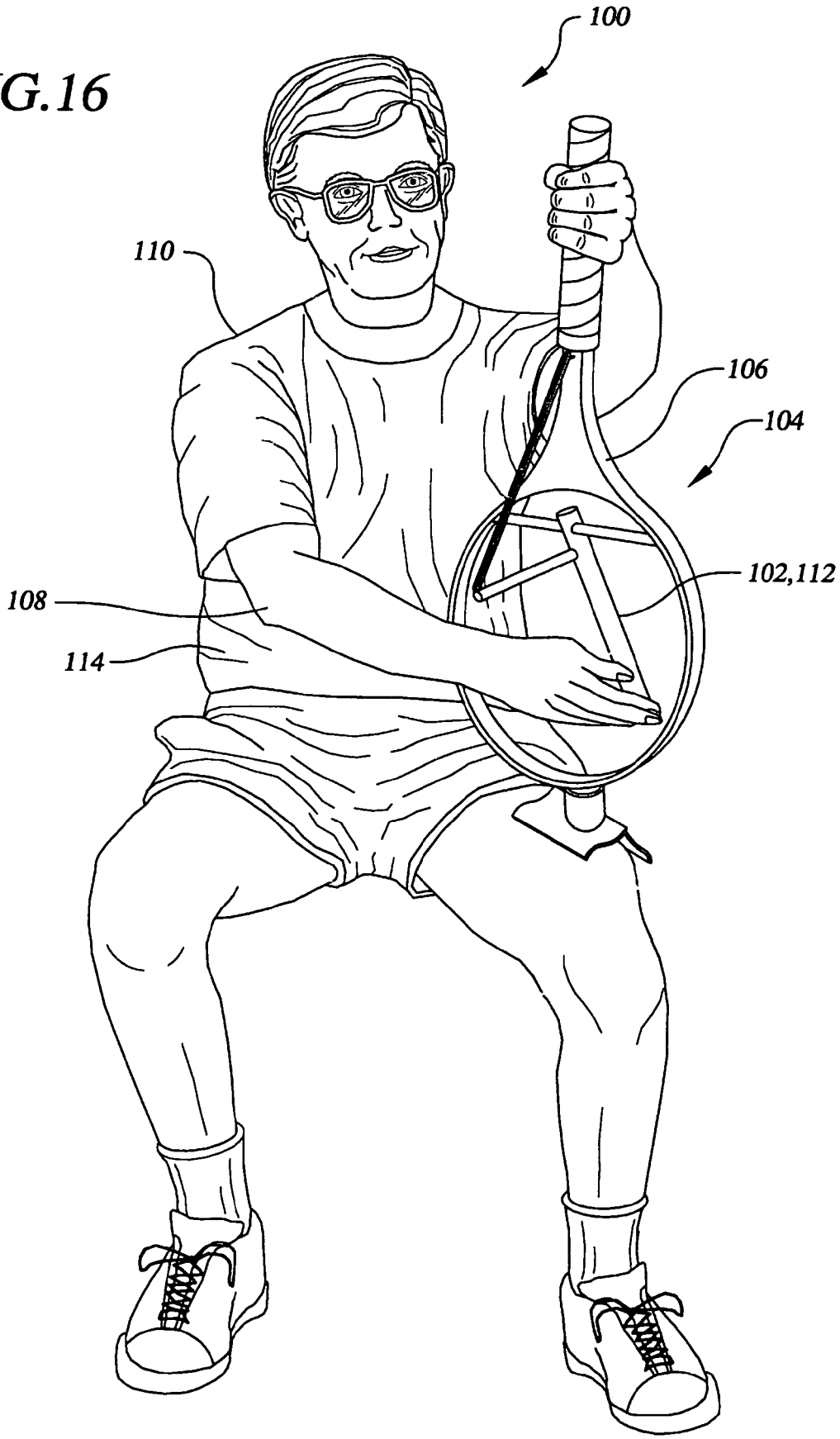
Figure 17:
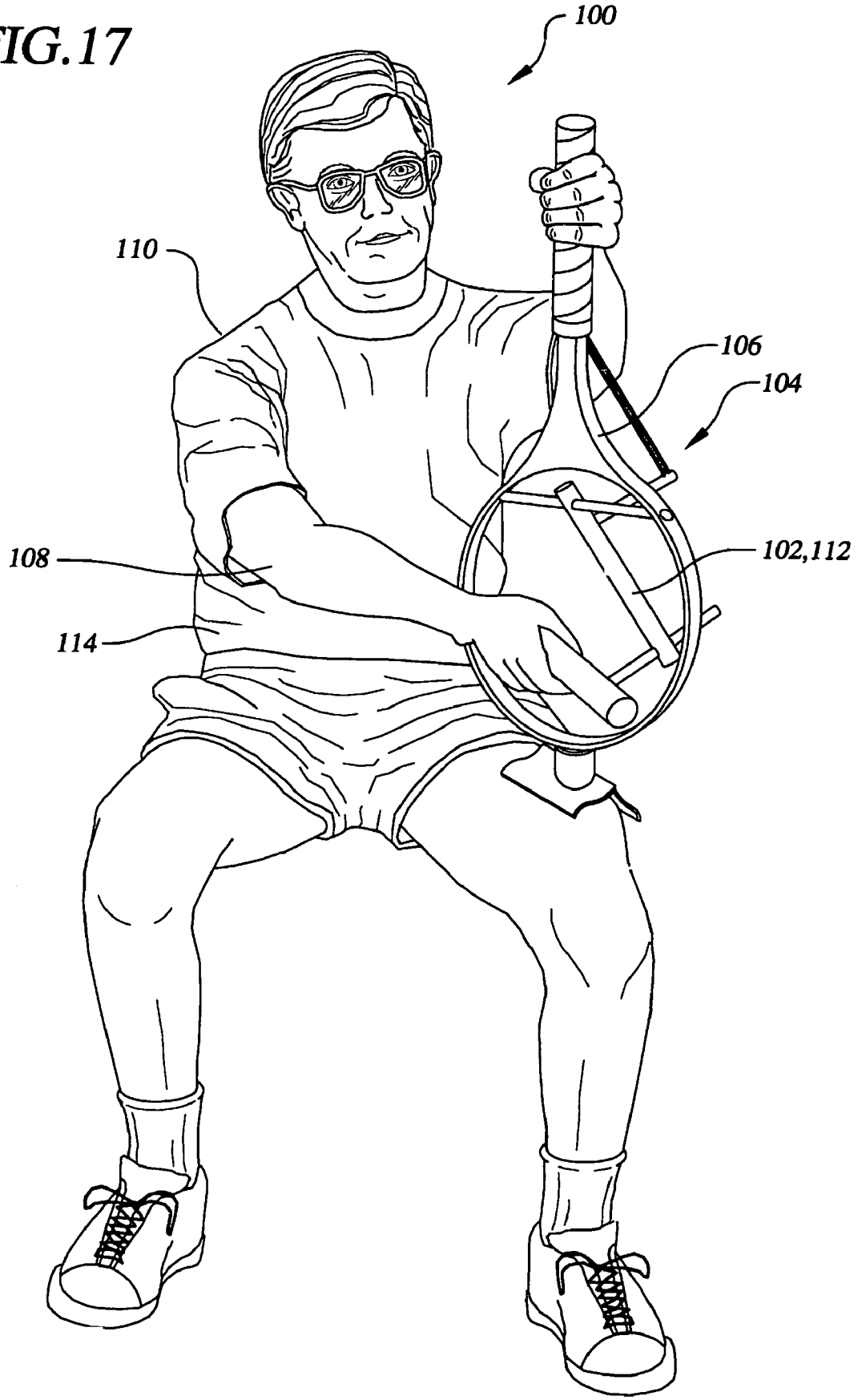

FIG. 16 is a front perspective view of the user pushing the distal end of the flexion-abduction apparatus, or the means for applying tension to the medial aspect of the user's substantially extended and immobile elbow joint while the user's shoulder joint undergoes a flexion-abduction movement, of the device shown in FIG. 3 and FIG. 4, toward the central support while keeping the user's elbow joint on the first side substantially extended and immobile, and while the user's shoulder joint on the first side undergoes a flexion-abduction movement FIG. 17 is a front perspective view of a user engaging the distal end of the extension-adduction apparatus, or engaging the means for applying tension to the lateral aspect of the user's substantially extended and immobile elbow joint while the user's shoulder joint undergoes an extension-adduction movement, of the device shown in FIG. 5 and FIG. 6

Figure 18:
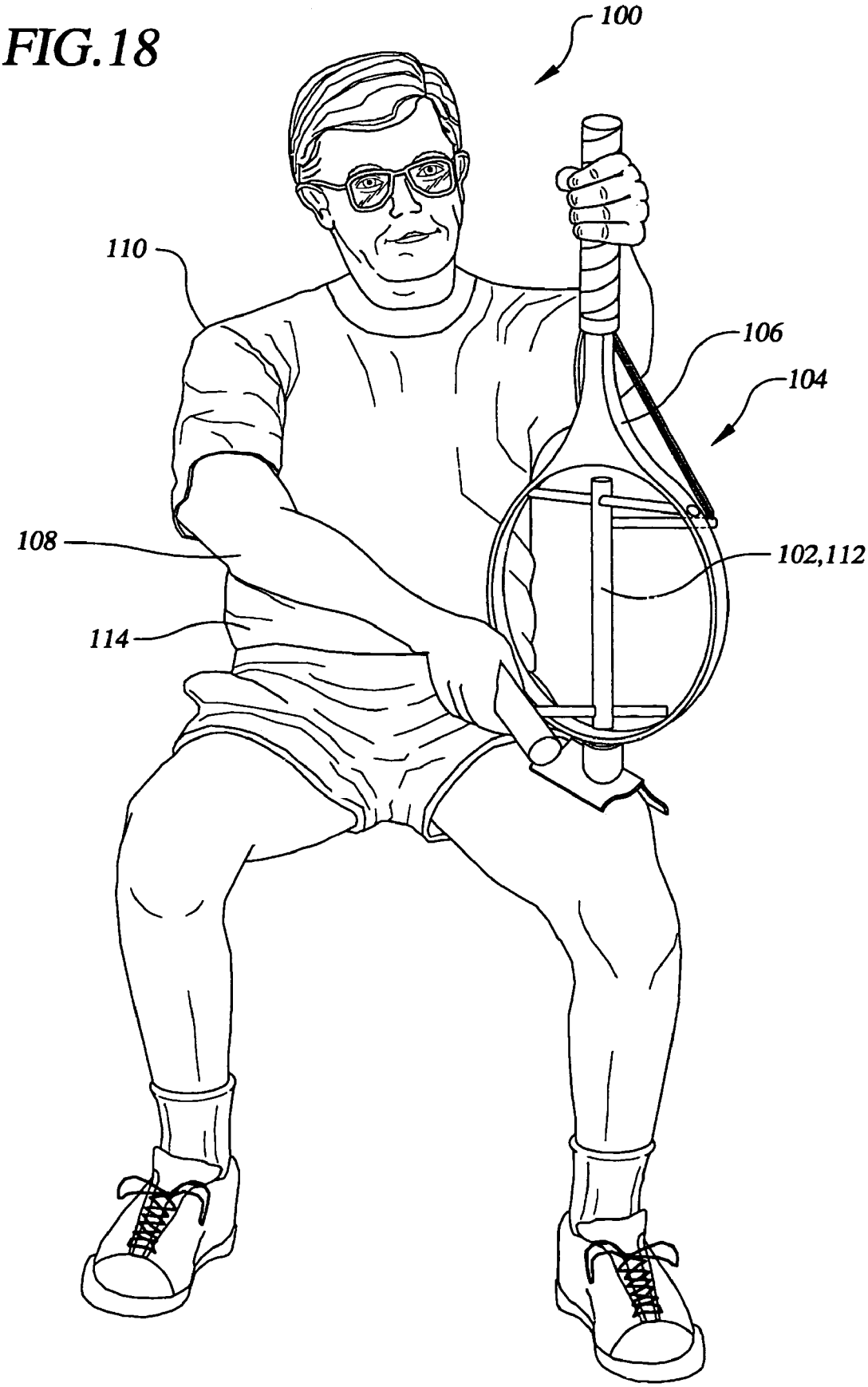
Figure 19:
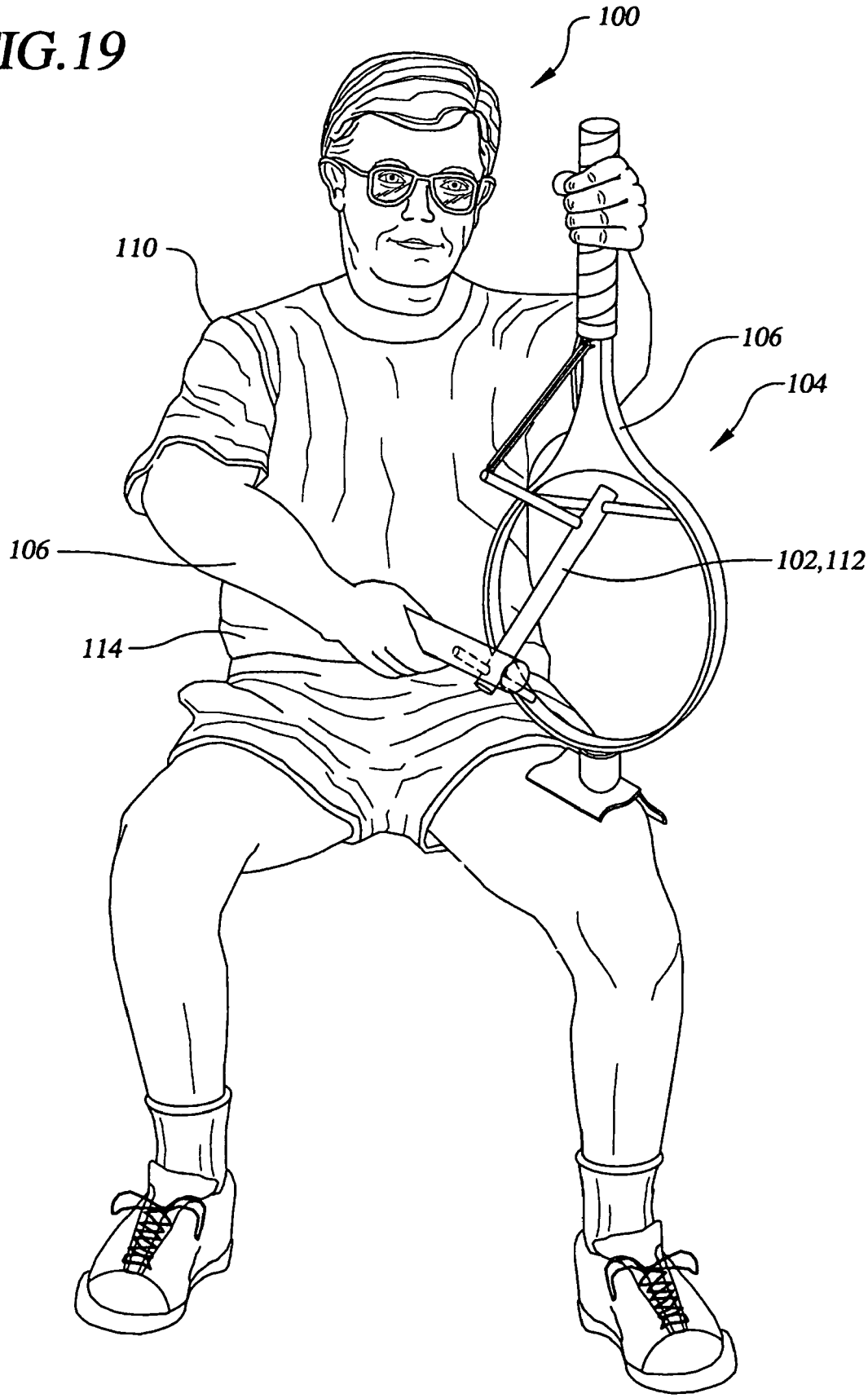
Figure 20:
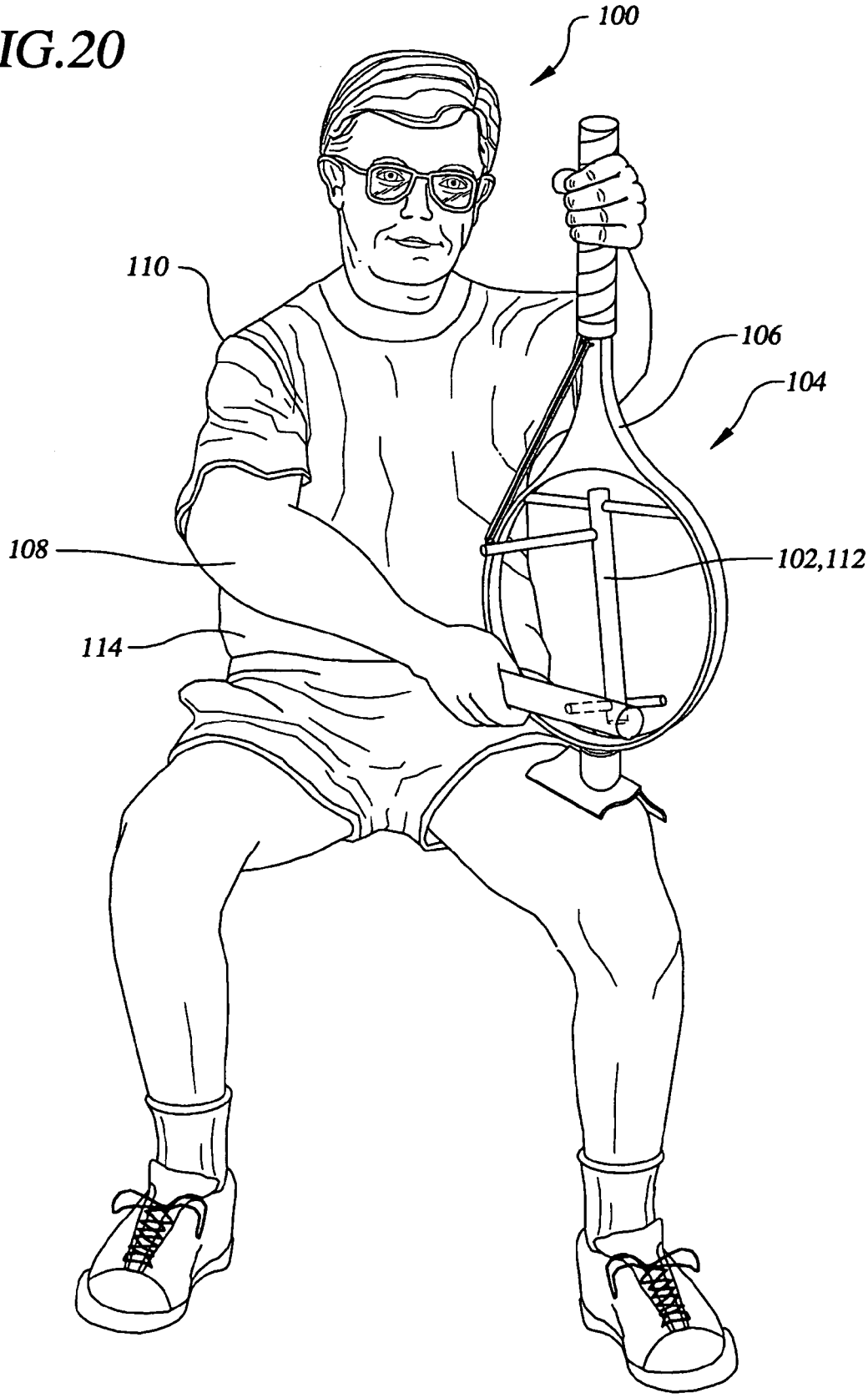

FIG. 18 is a front perspective view of the user pulling the distal end of the extension-adduction apparatus, or the means for applying tension to the lateral aspect of the user's substantially extended and immobile elbow joint while the user's shoulder joint undergoes an extension-adduction movement, of the device shown in FIG. 5 and FIG. 6, away from the central support while keeping the user's elbow joint on the first side substantially extended and immobile, and while the user's shoulder joint on the first side undergoes an extension-adduction movement FIG. 19 is a front perspective view of the user engaging the distal end of the flexion-abduction apparatus, or engaging the means for applying tension to the medial aspect of the user's substantially extended and immobile elbow joint while the user's shoulder joint undergoes a flexion-abduction movement, of the device shown in FIG. 5 and FIG. 6; and FIG. 20 is a front perspective view of the user pushing the distal end of the flexion-abduction apparatus, or the means for applying tension to the medial aspect of the user's substantially extended and immobile elbow joint while the user's shoulder joint undergoes a flexion-abduction movement, of the device shown in FIG. 5 and FIG. 6, toward the central support while keeping the user's elbow joint on the first side substantially extended and immobile, and while the user's shoulder joint on the first side undergoes a flexion-abduction movement.

DESCRIPTION

According to one embodiment of the present invention, there is provided a device for preventing the damage underlying lateral epicondylitis (tennis elbow) or medial epicondylitis (golfer's elbow), or both lateral epicondylitis (tennis elbow) and medial epicondylitis (golfer's elbow). According to another embodiment of the present invention, there is provided a device for repairing the damage underlying lateral epicondylitis (tennis elbow) or medial epicondylitis (golfer's elbow), or both lateral epicondylitis (tennis elbow) and medial epicondylitis (golfer's elbow). According to another embodiment of the present invention, there is provided a method for repairing the damage underlying lateral epicondylitis (tennis elbow) or medial epicondylitis (golfer's elbow), or both lateral epicondylitis (tennis elbow) and medial epicondylitis (golfer's elbow). The devices and methods of the present invention will now be disclosed in detail.

As used in this disclosure, the term "comprise" and variations of the term, such as "comprising" and "comprises," are not intended to exclude other additives, components, integers or steps.

As used in this disclosure, the terms "elbow" and "elbow joint" comprise the boney structures, muscles, tendons and connective tissues located at the juncture of the distal arm and proximal forearm, including at the medial epicondyle and the lateral epicondyle.

Though specific examples of materials and dimensions are given in this disclosure for some of the parts of the device, as will be understood by those with skill in the art with reference to this disclosure, each part can comprise any suitable material and can be any suitable dimension for the purposes disclosed. No specific example of material or dimension given in this disclosure should be considered to be limiting.

In one embodiment, the present invention is a device that can be used to prevent the damage underlying lateral epicondylitis (tennis elbow) or medial epicondylitis (golfer's elbow), or both lateral epicondylitis (tennis elbow) and medial epicondylitis (golfer's elbow), and that can be used to repair the damage underlying lateral epicondylitis (tennis elbow) or medial epicondylitis (golfer's elbow), or both lateral epicondylitis (tennis elbow) and medial epicondylitis (golfer's elbow). The device comprises means for central support. In one embodiment, in addition to the means for central support, the device further comprises, connected to the means for central support, one or more than one means for applying tension to the medial aspect of the user's substantially extended and immobile elbow joint while the user's shoulder joint undergoes a flexion-abduction movement. In another embodiment, in addition to the means for central support, the device further comprises, connected to the means for central support, one or more than one means for applying tension to the lateral aspect of the user's substantially extended and immobile elbow joint while the user's shoulder joint undergoes an extension-adduction movement. In another embodiment, the device further comprises, connected to the means for central support, both one or more than one means for applying tension to the medial aspect of the user's substantially extended and immobile elbow joint while the user's shoulder joint undergoes a flexion-abduction movement, and one or more than one means for applying tension to the lateral aspect of the user's substantially extended and immobile elbow joint while the user's shoulder joint undergoes an extension-adduction movement. As will be understood by those with skill in the art with reference to this disclosure, the means for central support, the means for applying tension to the medial aspect of the user's substantially extended and immobile elbow joint while the user's shoulder joint undergoes a flexion-abduction movement, and the means for applying tension to the lateral aspect of the user's substantially extended and immobile elbow joint while the user's shoulder joint undergoes an extension-adduction movement can each be a variety of embodiments. Some of the embodiments are disclosed in detail below.

In another embodiment, the present invention is a device that can be used to prevent the damage underlying lateral epicondylitis (tennis elbow) or medial epicondylitis (golfer's elbow), or both lateral epicondylitis (tennis elbow) and medial epicondylitis (golfer's elbow), and that can be used to repair the damage underlying lateral epicondylitis (tennis elbow) or medial epicondylitis (golfer's elbow), or both lateral epicondylitis (tennis elbow) and medial epicondylitis (golfer's elbow). The device comprises a central support. In one embodiment, in addition to the central support, the device further comprises, connected to the central support, one or more than one apparatus for applying tension to the lateral aspect of the user's substantially extended and immobile elbow joint while the user's shoulder joint undergoes an extension-adduction movement. In another embodiment, in addition to the central support, the device further comprises, connected to the central support, one or more than one apparatus for applying tension to the medial aspect of the user's substantially extended and immobile elbow joint while the user's shoulder joint undergoes a flexion-abduction movement. In another embodiment, the device comprises, connected to the central support, both one or more than one apparatus for applying tension to the medial aspect of the user's substantially extended and immobile elbow joint while the user's shoulder joint undergoes a flexion-abduction movement, and one or more than one apparatus for applying tension to the lateral aspect of the user's substantially extended and immobile elbow joint while the user's shoulder joint undergoes an extension-adduction movement. As will be understood by those with skill in the art with reference to this disclosure, the central support, the apparatus for applying tension to the user's substantially extended and immobile elbow joint while the user's shoulder joint undergoes a flexion-abduction movement, and the apparatus for applying tension to the user's substantially extended and immobile elbow joint while the user's shoulder joint undergoes an extension-adduction movement can each be a variety of embodiments. Some of the embodiments will now be disclosed in detail.

Figure 8:
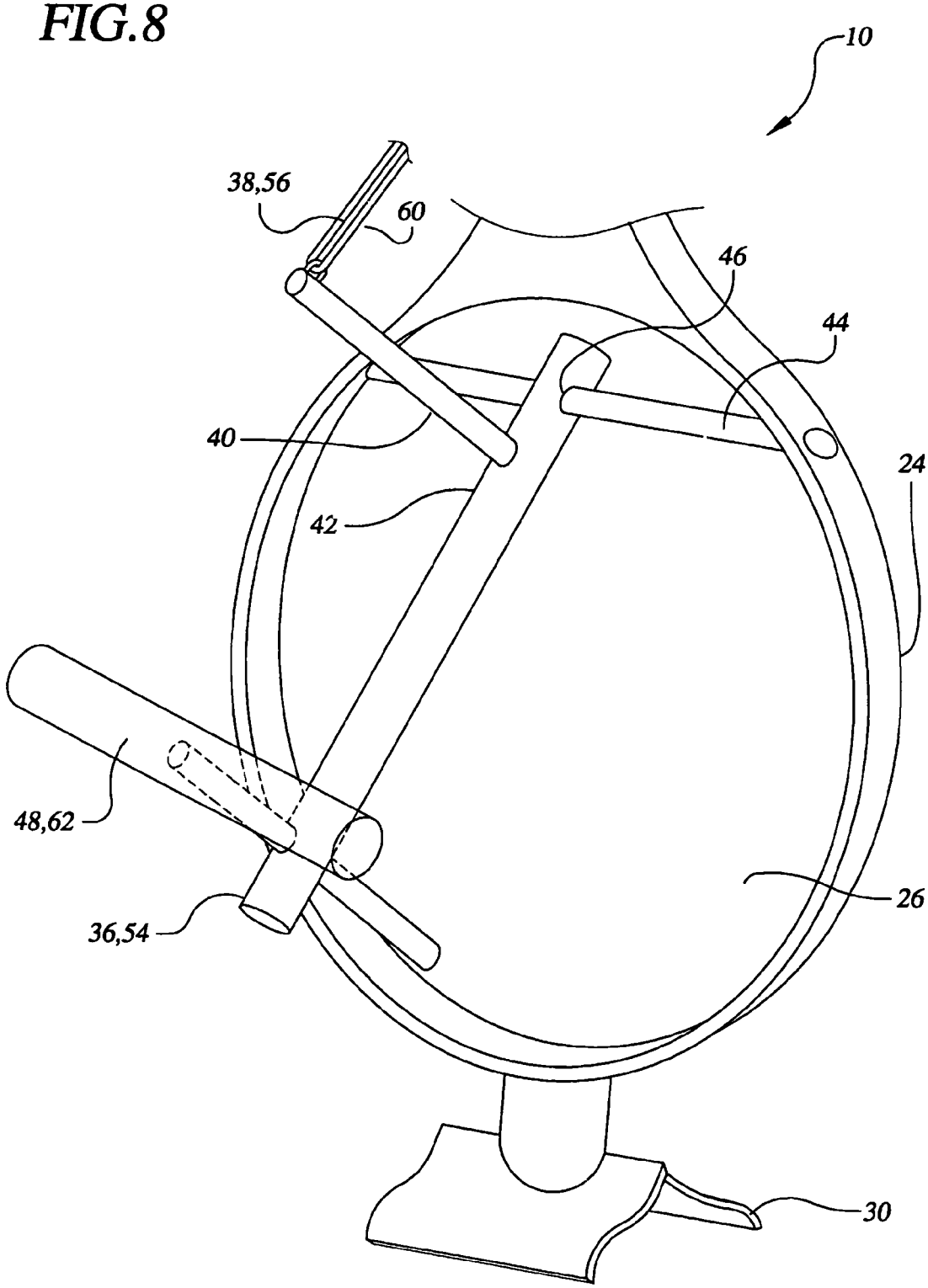
FIG. 8 is an elevational perspective view of the embodiment of the device shown in FIG. 5, axially rotated 90° from the view shown in FIG. 7.
Figure 9:
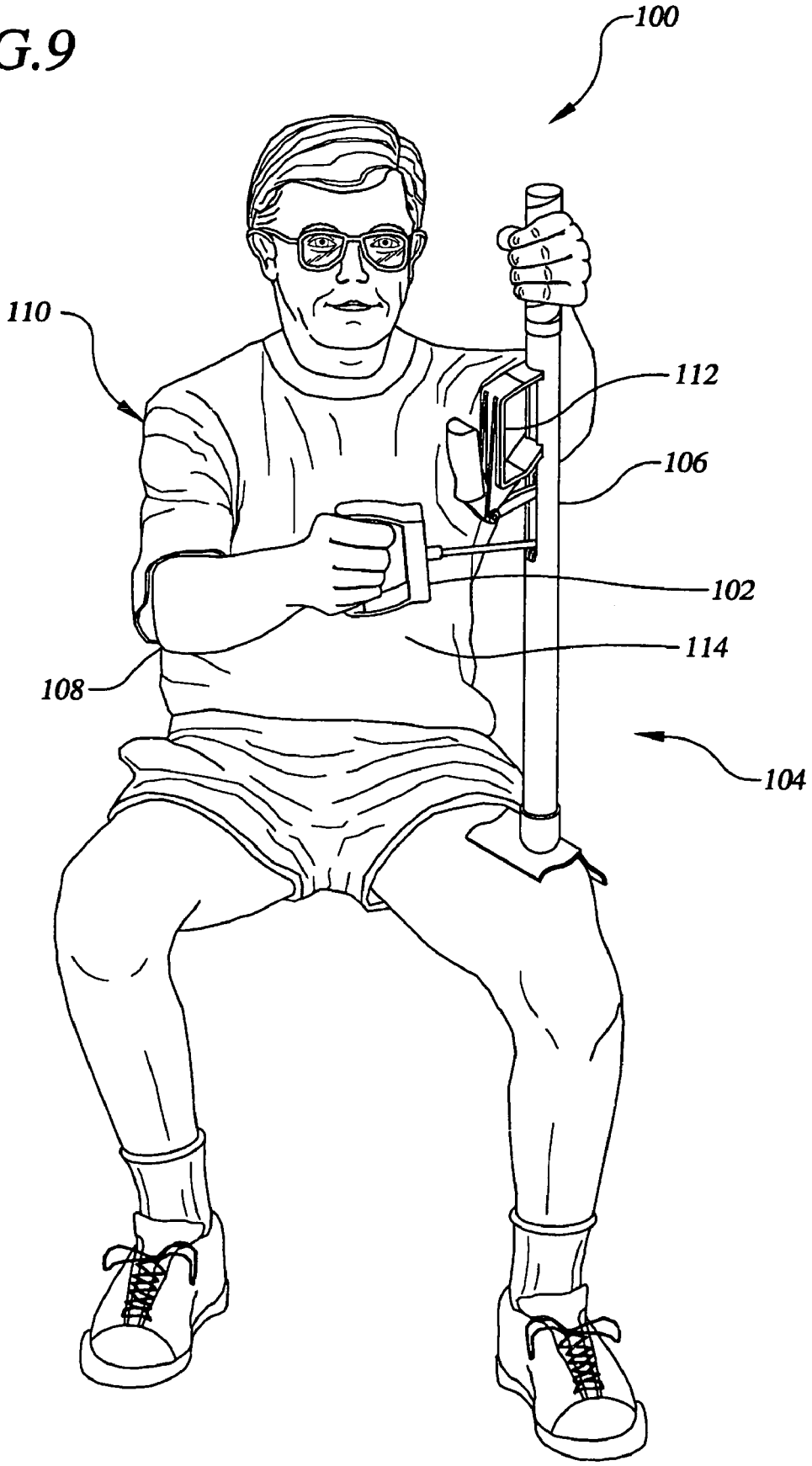
FIG. 9 is a front perspective view of a user engaging the distal end of the extension-adduction apparatus, or engaging the means for applying tension to the lateral aspect of the user's substantially extended and immobile elbow joint while the user's shoulder joint undergoes an extension-adduction movement, of the device shown in FIG. 1 and FIG. 2.

Referring now to FIG. 1 through FIG. 8, there are shown respectively, an elevational perspective view of one embodiment of the device according to the present invention (FIG. 1); an elevational perspective view of the embodiment of the device shown in FIG. 1, axially rotated 90° from the view shown in FIG. 1 (FIG. 2); an elevational perspective view of another embodiment of the device according to the present invention (FIG. 3); an elevational perspective view of the embodiment of the device shown in FIG. 3, axially rotated 90° from the view shown in FIG. 3 (FIG. 4); an elevational perspective view of the distal end of a variation of the embodiment of the device shown in FIG. 3 (FIG. 5); an elevational perspective view of the embodiment of the device shown in FIG. 5, axially rotated 90° from the view shown in FIG. 5 (FIG. 6); an elevational perspective view of the distal end of a variation of the embodiment of the device shown in FIG. 3 (FIG. 7); and an elevational perspective view of the embodiment of the device shown in FIG. 5, axially rotated 90° from the view shown in FIG. 5 (FIG. 8).

As can be seen, the device 10 comprises a central support 12 having a proximal end 14, a distal end 16 and an intermediate portion 18 between and connected to the proximal end 14 and the distal end 16. In a preferred embodiment, the central support 12 comprises a rigid bar, or as shown in FIG. 1 and FIG. 2, a rigid tube 20.

In another preferred embodiment, as shown in FIG. 3 through FIG. 6, the proximal end 14 of the central support 12 is a rigid, inverted "Y" shaped structure 22 having a single bar proximally, dividing into two bars distally. In this embodiment, the intermediate portion 18 of the central support 12 further comprises a rigid rim 24 surrounding a central opening 26. The rim 24 can be a circular, square, rectangular or any other shape suitable for the disclosed purpose, such as oval, as shown. The central support 12 can have any suitable diameter, as will be understood by those with skill in the art with reference to this disclosure.

The central support 12 can be any suitable axial length for the disclosed purpose, as will be understood by those with skill in the art with reference to this disclosure. In a preferred embodiment, the central support 12 has an axial length of between about 25 cm and about 150 cm. In a particularly preferred embodiment, the central support 12 has an axial length of between about 50 cm and about 100 cm. The central support 12 can comprise any suitable material, as will be understood by those with skill in the art with reference to this disclosure. In a preferred embodiment, the central support 12 comprises a substantially non-flexible material such as aluminum alloy, or a rigid polymer.

In one embodiment, the proximal end 14 of the central support 12 comprises a grip 28 configured to facilitate grasping by the user's fingers. In a preferred embodiment, the grip 28 comprises a cap configured to fit snugly over the proximal end 14 of the central support 12, and comprises circumferential indentations configured to receive the user's fingers. However, other grips are also suitable for the disclosed purpose, as will be understood by those with skill in the art with reference to this disclosure, such as straps, loops or bars.

In one embodiment, the distal end of the central support 12 comprises a stabilizer 30. In one embodiment, the stabilizer 30 has a flat distal surface, such as for resting on the floor. In a preferred embodiment, the stabilizer 30 is configured to conform to the user's distal anterior thigh adjacent the user's knee cap or to the anterior aspect of the user's knee or both. In a particularly preferred embodiment, the stabilizer 30 comprises a plate that has been molded to be convex, as seen looking distally aligned with the central support 12. In another preferred embodiment, the stabilizer 30 comprises a padded distal surface to increase contact with the user's distal anterior thigh. However, other stabilizers are also suitable for the disclosed purpose, as will be understood by those with skill in the art with reference to this disclosure, such as multiple prongs. In a particularly preferred embodiment, the distal end of the central support 12 can be extended, such as adding an extender, so that the stabilizer 30 can be rested on user's distal anterior thigh adjacent the user's knee cap or anterior aspect of the user's knee, or on the floor, at the discretion of the user.

In one embodiment, in addition to the central support 12, the device further comprises, one or more than one extension-adduction apparatus 32. The extension-adduction apparatus 32 allows the user of the device to apply tension to lateral aspect of the user's substantially extended and immobile elbow joint while the user's shoulder joint undergoes an extension-adduction movement. The extension-adduction apparatus 32 comprises a proximal end 34 connected to the central support 12, and a distal end 36 connected to the proximal end 34. The extension-adduction apparatus 32 further comprises a tensioner 38 for applying tension to the distal end of the extension-adduction apparatus 32. In a preferred embodiment, the tensioner 38 comprises an elastic cord of suitable elasticity for the disclosed purpose, as shown in FIG. 1 through FIG. 6. In another preferred embodiment, the tensioner 38 is a spring of suitable elasticity for the disclosed purpose. However, the tensioner 38 can be any equivalent appliance for the disclosed purpose, as will be understood by those with skill in the art with reference to this disclosure.

In one embodiment, the tensioner 38 further comprises a lever, as shown in FIG. 3 through FIG. 6. In this embodiment, the lever 40 comprises a rigid "L" shaped structure 42 and a rigid strut 44. The proximal end of the "L" shaped structure 42 is connected to the distal end of the elastic cord, spring or equivalent appliance, and comprises a bore 46 at or near the bend in the "L" shaped structure 42. The strut 44 spans the rim 24 of the embodiments of the device comprising a rim 24 as part of the intermediate portion 18 of the central support 12 transversely toward the proximal end 14 of the central support 12. The strut 44 passes through the bore 46 in the "L" shaped structure 42, thereby allowing the "L" shaped structure 42 to pivot around the strut 44.

The extension-adduction apparatus 32 further comprises a handle 48 at the distal end 36. In a particularly preferred embodiment, the handle 48 is configured to allow the user's fingers to grasp the handle 48 to pull the handle 48 laterally. The handle 48 can be a rim 24, as shown in FIG. 1 and FIG. 2, can be a bar, as shown in FIG. 3 through FIG. 8, or can be any equivalent appliance for the disclosed purpose, as will be understood by those with skill in the art with reference to this disclosure. In one embodiment, not shown, the handle 48 is shaped like a tennis racquet handle or like a golf club handle. The tensioner 38 applies tension to the handle 48 when the handle 48 is pulled laterally.

In another embodiment, in addition to the central support 12, the device further comprises, one or more than one flexion-abduction apparatus 50. The flexion-abduction apparatus 50 allows the user of the device to apply tension to medial aspect of the user's substantially extended and immobile elbow joint while the user's shoulder joint undergoes a flexion-abduction movement. The flexion-abduction apparatus 50 comprises a proximal end 52 connected to the central support 12, and a distal end 54 connected to the proximal end 52. The flexion-abduction apparatus 50 further comprises a tensioner 56 for applying tension to the distal end 54 of the flexion-abduction apparatus 50.

In a preferred embodiment, as shown in FIG. 1 and FIG. 2, the tensioner 56 comprises a strut 58, and comprises an elastic cord or spring 60 of suitable elasticity for the disclosed purpose. The proximal end of the elastic cord or spring is connected to the central support 12, and the distal end of the elastic cord or spring is connected to a handle 62, creating a pivoting point for the handle 62.

In another preferred embodiment, the tensioner 56 comprises an elastic cord of suitable elasticity for the disclosed purpose, as shown in FIG. 3 through FIG. 6. In another preferred embodiment, the tensioner 56 is a spring of suitable elasticity for the disclosed purpose. However, the tensioner 56 can be any equivalent appliance for the disclosed purpose, as will be understood by those with skill in the art with reference to this disclosure.

In one embodiment, the tensioner 56 further comprises a lever 40, as shown in FIG. 3 through FIG. 6. In this embodiment, the lever 40 comprises a rigid "L" shaped structure 42 and a rigid strut 44. The proximal end of the "L" shaped structure 42 is connected to the distal end of the elastic cord, spring or equivalent appliance, and comprises a bore 46 at or near the bend in the "L" shaped structure 42. The strut 44 spans the rim 24 of the embodiments of the device comprising a rim 24 as part of the intermediate portion 18 of the central support 12, transversely toward the proximal end 14 of the central support 12. The strut 44 passes through the bore 46 in the "L" shaped structure 42, thereby allowing the "L" shaped structure 42 to pivot around the strut 44.

The flexion-abduction apparatus 50 further comprises a handle 48 at the distal end. In a particularly preferred embodiment, the handle 48 is configured to allow the user's fingers to grasp the handle 48 to pull the handle 48 laterally. The handle 48 can be a grip 28, as shown in FIG. 1 and FIG. 2, can be a bar, as shown in FIG. 3 through FIG. 8, or can be any equivalent appliance for the disclosed purpose, as will be understood by those with skill in the art with reference to this disclosure. In one embodiment, not shown, the bar is shaped like a tennis racquet handle or like a golf club handle. The tensioner 56 applies tension to the handle 48 when the handle 48 is pushed toward the central support 12.

In a preferred embodiment, as shown in FIG. 1 through FIG. 6, the device comprises both a flexion-abduction apparatus 50 and an extension-adduction apparatus 32 connected to the central support 12. In a particularly preferred embodiment, as shown in FIG. 3 through FIG. 6, the flexion-abduction apparatus 50 and the extension-adduction apparatus 32 are combined into the same apparatus, and the central support 12 of the device is rotated 180° as needed to convert the flexion-abduction apparatus 50 into the extension-adduction apparatus 32.

According to another embodiment of the present invention, there is provided a method for preventing the damage underlying lateral epicondylitis (tennis elbow) to a user's elbow on the user's first side, or for treating a user's elbow for lateral epicondylitis (tennis elbow) on the user's first side. According to another embodiment of the present invention, there is provided a method for preventing the damage underlying medial epicondylitis (golfer's elbow) to a user's elbow on the user's first side, or for treating a user's elbow for medial epicondylitis (golfer's elbow) on the user's first side. According to another embodiment of the present invention, there is provided a method for both preventing the damage underlying both lateral epicondylitis (tennis elbow) and medial epicondylitis (golfer's elbow) to a user's elbow on the user's first side, or for both treating a user's elbow for both lateral epicondylitis (tennis elbow) and medial epicondylitis (golfer's elbow) on the user's first side, or for both preventing the damage underlying both lateral epicondylitis (tennis elbow) and medial epicondylitis (golfer's elbow) to a user's elbow on the user's first side, and for treating a user's elbow for both lateral epicondylitis (tennis elbow) and medial epicondylitis (golfer's elbow) on the user's first side.

As will be understood by those with skill in the art with reference to this disclosure, the method for prevention is performed by the user before the user has lateral epicondylitis (tennis elbow) or medial epicondylitis (golfer's elbow), while the method for treating is performed by the user after the user has lateral epicondylitis (tennis elbow) or medial epicondylitis (golfer's elbow).

Referring now to FIG. 9 through FIG. 18, there are shown, respectively, front perspective views of: a user 100 engaging the distal end of the extension-adduction apparatus 102, or engaging the means for applying tension to the lateral aspect of the user's substantially extended and immobile elbow joint while the user's shoulder joint undergoes an extension-adduction movement 102, of the device 104 shown in FIG. 1 and FIG. 2 (FIG. 9); the user 100 pulling the distal end of the extension-adduction apparatus 102, or the means for applying tension to the lateral aspect of the user's substantially extended and immobile elbow joint while the user's shoulder joint undergoes an extension-adduction movement 102, of the device 102 shown in FIG. 1 and FIG. 2, away from the central support 106 while keeping the user's elbow joint 108 on the first side substantially extended and immobile, and while the user's shoulder joint 110 on the first side undergoes an extension-adduction movement 102 (FIG. 10); the user 100 engaging the distal end of the flexion-abduction apparatus 112, or engaging the means for applying tension to the medial aspect of the user's substantially extended and immobile elbow joint while the user's shoulder joint undergoes a flexion-abduction movement 112, of the device 104 shown in FIG. 1 and FIG. 2 (FIG. 11); the user 100 pushing the distal end of the flexion-abduction apparatus 112, or the means for applying tension to the medial aspect of the user's substantially extended and immobile elbow joint while the user's shoulder joint undergoes a flexion-abduction movement 112, of the device 104 shown in FIG. 1 and FIG. 2, toward the central support 106 while keeping the user's elbow joint 108 on the first side substantially extended and immobile, and while the user's shoulder joint 110 on the first side undergoes a flexion-abduction movement (FIG. 12); a user 100 engaging the distal end of the extension-adduction apparatus 102, or engaging the means for applying tension to the lateral aspect of the user's substantially extended and immobile elbow joint while the user's shoulder joint undergoes an extension-adduction movement 102, of the device 104 shown in FIG. 3 and FIG. 4 (FIG. 13); the user 100 pulling the distal end of the extension-adduction apparatus 102, or the means for applying tension to the lateral aspect of the user's substantially extended and immobile elbow joint while the user's shoulder joint undergoes an extension-adduction movement 102, of the device 104 shown in FIG. 3 and FIG. 4, away from the central support 106 while keeping the user's elbow joint 108 on the first side substantially extended and immobile, and while the user's shoulder joint 110 on the first side undergoes an extension-adduction movement 102 (FIG. 14); the user 100 engaging the distal end of the flexion-abduction apparatus 112, or engaging the means for applying tension to the medial aspect of the user's substantially extended and immobile elbow joint while the user's shoulder joint undergoes a flexion-abduction movement 112, of the device 104 shown in FIG. 3 and FIG. 4 (FIG. 15); the user 100 pushing the distal end of the flexion-abduction apparatus 112, or the means for applying tension to the medial aspect of the user's substantially extended and immobile elbow joint while the user's shoulder joint undergoes a flexion-abduction movement 112, of the device 104 shown in FIG. 3 and FIG. 4, toward the central support 106 while keeping the user's elbow joint 108 on the first side substantially extended and immobile, and while the user's shoulder joint 110 on the first side undergoes a flexion-abduction movement 112 (FIG. 16); a user 100 engaging the distal end of the extension-adduction apparatus 102, or engaging the means for applying tension to the lateral aspect of the user's substantially extended and immobile elbow joint while the user's shoulder joint undergoes an extension-adduction movement 102, of the device 104 shown in FIG. 5 and FIG. 6 (FIG. 17); the user 100 pulling the distal end of the extension-adduction apparatus 102, or the means for applying tension to the lateral aspect of the user's substantially extended and immobile elbow joint while the user's shoulder joint undergoes an extension-adduction movement 102, of the device 104 shown in FIG. 5 and FIG. 6, away from the central support 106 while keeping the user's elbow joint 108 on the first side substantially extended and immobile, and while the user's shoulder joint 110 on the first side undergoes an extension-adduction movement 102 (FIG. 18); the user 100 engaging the distal end of the flexion-abduction apparatus 112, or engaging the means for applying tension to the medial aspect of the user's substantially extended and immobile elbow joint while the user's shoulder joint undergoes a flexion-abduction movement 112, of the device 104 shown in FIG. 5 and FIG. 6 (FIG. 19); and the user 100 pushing the distal end of the flexion-abduction apparatus 112, or the means for applying tension to the medial aspect of the user's substantially extended and immobile elbow joint while the user's shoulder joint undergoes a flexion-abduction movement 112, of the device 104 shown in FIG. 5 and FIG. 6, toward the central support 106 while keeping the user's elbow joint 108 on the first side substantially extended and immobile, and while the user's shoulder joint 110 on the first side undergoes a flexion-abduction movement 112 (FIG. 20).

In one embodiment of the present invention, there is provided a method to prevent the damage underlying lateral epicondylitis (tennis elbow) to a user's elbow on the user's first side, or to treat a user's elbow for lateral epicondylitis (tennis elbow) on the user's first side, or both to prevent the damage underlying lateral epicondylitis (tennis elbow) to a user's elbow on the user's first side and to treat a user's elbow for lateral epicondylitis (tennis elbow) on the user's first side. The method comprises, first, providing a device 104 according to the present invention. Next, in a preferred embodiment, the user 100 flexes the user's hips, such as by assuming a sitting or squatting position. Then, the user 100 stabilizes the central axis of the device 104 substantially parallel to the long axis of the user's trunk 114 by placing the distal end of the central support 106, or the means for central support 106, on the user's anterior thigh adjacent the user's knee cap or on the anterior aspect of the user's knee, or both, on the user's second side, which is contralateral to first side and the user 100 grips the proximal end 14 of the central support 106, or the means for central support 106, with the user's hand on the user's second side. In another preferred embodiment, the user 100 places the distal end of the device 104 on the ground or on another structure other than the user's anterior thigh adjacent the user's knee cap or on the anterior aspect of the user's knee.

Next, the user 100 engages the distal end of the extension-adduction apparatus 102, or engages the means for applying tension to the lateral aspect of the user's substantially extended and immobile elbow joint while the user's shoulder joint undergoes an extension-adduction movement 102, with the user's hand on the user's first side. Then, the user 100 pulls the distal end of the extension-adduction apparatus 102, or the means for applying tension to the lateral aspect of the user's substantially extended and immobile elbow joint while the user's shoulder joint undergoes an extension-adduction movement 102, away from the central support 106 while keeping the user's elbow joint 108 on the first side substantially extended and immobile, and while the user's shoulder joint 110 on the first side undergoes an extension-adduction movement 102. This movement places gradually increasing tension on the lateral epicondyle of the user's elbow joint 108 on the first side. Next, the user 100 allows the distal end of the extension-adduction apparatus 102, or the means for applying tension to the lateral aspect of the user's substantially extended and immobile elbow joint while the user's shoulder joint undergoes an extension-adduction movement 102, to return toward the central support 106, gradually decreasing tension on the lateral epicondyle of the user's elbow joint 108 on the first side. The user 100 repeats these movements a plurality of times.

According to another embodiment of the present invention, there is provided a method for preventing the damage underlying lateral epicondylitis (tennis elbow'to a user's elbow on the user's first side, or for treating a user's elbow for lateral epicondylitis (tennis elbow) on the user's first side. According to another embodiment of the present invention, there is provided a method for preventing the damage underlying medial epicondylitis (golfer's elbow) to a user's elbow on the user's first side, or for treating a user's elbow for medial epicondylitis (golfer's elbow) on the user's first side. According to another embodiment of the present invention, there is provided a method for preventing the damage underlying both lateral epicondylitis (tennis elbow) and medial epicondylitis (golfer's elbow) to a user's elbow on the user's first side, or for treating a user's elbow for both medial epicondylitis (golfer's elbow) and medial epicondylitis (golfer's elbow) on the user's first side.

In one embodiment of the present invention, there is provided a method to prevent the damage underlying medial epicondylitis (golfer's elbow) to a user's elbow on the user's first side, or to treat a user's elbow for medial epicondylitis (golfer's elbow) on the user's first side, or both to prevent the damage underlying medial epicondylitis (golfer's elbow) to a user's elbow on the user's first side and to treat a user's elbow for medial epicondylitis (golfer's elbow) on the user's first side. The method comprises, first, providing a device 104 according to the present invention. Next, the user 100 flexes the user's hips, such as by assuming a sitting or squatting position. Then, the user 100 stabilizes the central axis of the device 104 substantially parallel to the long axis of the user's trunk 114 by placing the distal end of the central support 106, or the means for central support 106, on the user's anterior thigh adjacent the user's knee cap or on the anterior aspect of the user's knee, or both, on the user's second side, which is contralateral to first side and the user 100 grips the proximal end 14 of the central support 106, or the means for central support 106, with the user's hand 116 on the user's second side. Next, the user 100 engages the distal end of the flexion-abduction apparatus 112, or the means for applying tension to the medial aspect of the user's substantially extended and immobile elbow joint while the user's shoulder joint undergoes a flexion-abduction movement 112, with the user's hand on the user's first side. Then, the user 100 pushes the distal end of the flexion-abduction apparatus 112, or the means for applying tension to the medial aspect of the user's substantially extended and immobile elbow joint while the user's shoulder joint undergoes a flexion-abduction movement 112, toward the central support 106 while keeping the user's elbow joint 108 on the first side substantially extended and immobile, and while the user's shoulder joint 110 on the first side undergoes a flexion-abduction movement 112. This movement places gradually increasing tension on the medial epicondyle of the user's elbow joint 108 on the first side. Next, the user 100 allows the distal end of the flexion-abduction apparatus 112, or the means for applying tension to the medial aspect of the user's substantially extended and immobile elbow joint while the user's shoulder joint undergoes a flexion-abduction movement 112, to return away from the central support 106, gradually decreasing tension on the medial epicondyle of the user's elbow joint 108 on the first side. The user 100 repeats these movements a plurality of times.

According to another embodiment of the present invention, there is provided a method for preventing the damage underlying both lateral epicondylitis (tennis elbow) and medial epicondylitis (golfer's elbow) to a user's elbow on the user's first side, or for treating a user's elbow for both lateral epicondylitis (tennis elbow) and medial epicondylitis (golfer's elbow) on the user's first side, or for both preventing the damage underlying both lateral epicondylitis (tennis elbow) and medial epicondylitis (golfer's elbow) to a user's elbow on the user's first side, and for treating a user's elbow for both lateral epicondylitis (tennis elbow) and medial epicondylitis (golfer's elbow) on the user's first side. The method comprises, first, providing a device 104 according to the present invention. Next, the user 100 flexes the user's hips, such as by assuming a sitting or squatting position. Then, the user 100 stabilizes the central axis of the device 104 substantially parallel to the long axis of the user's trunk 114 by placing the distal end of the central support 106, or the means for central support 106, on the user's anterior thigh adjacent the user's knee cap or on the anterior aspect of the user's knee, or both, on the user's second side, which is contralateral to first side and the user 100 grips the proximal end 14 of the central support 106, or the means for central support 106, with the user's hand on the user's second side. Next, the user 100 engages the distal end of the flexion-abduction apparatus 112, or the means for applying tension to the medial aspect of the user's substantially extended and immobile elbow joint while the user's shoulder joint undergoes a flexion-abduction movement 112, with the user's hand on the user's first side. Then, the user 100 pushes the distal end of the flexion-abduction apparatus 112, or the means for applying tension to the medial aspect of the user's substantially extended and immobile elbow joint while the user's shoulder joint undergoes a flexion-abduction movement 112, toward the central support 106 while keeping the user's elbow joint 108 on the first side substantially extended and immobile, and while the user's shoulder joint 110 on the first side undergoes a flexion-abduction movement 112. This movement places gradually increasing tension on the medial epicondyle of the user's elbow joint 108 on the first side. Next, the user 100 allows the distal end of the flexion-abduction apparatus 112, or the means for applying tension to the medial aspect of the user's substantially extended and immobile elbow joint while the user's shoulder joint undergoes a flexion-abduction movement 112, to return awaiting from the central support 106, gradually decreasing tension on the medial epicondyle of the user's elbow joint 108 on the first side. The user 100 repeats these movements a plurality of times. Next, the user 100 engages the distal end of the extension-adduction apparatus 102, or the means for applying tension to the lateral aspect of the user's substantially extended and immobile elbow joint while the user's shoulder joint undergoes an extension-adduction movement 102, with the user's hand on the user's first side. Then, the user 100 pulls the distal end of the extension-adduction apparatus 102, or the means for applying tension to the lateral aspect of the user's substantially extended and immobile elbow joint while the user's shoulder joint undergoes an extension-adduction movement 102, away from the central support 106 while keeping the user's elbow joint 108 on the first side substantially extended and immobile, and while the user's shoulder joint 110 on the first side undergoes an extension-adduction movement 102. This movement places gradually increasing tension on the lateral epicondyle of the user's elbow joint 108 on the first side. Next, the user 100 allows the distal end of the extension-adduction apparatus 102, or the means for applying tension to the lateral aspect of the user's substantially extended and immobile elbow joint while the user's shoulder joint undergoes an extension-adduction movement 102, to return toward the central support 106, gradually decreasing tension on the lateral epicondyle of the user's elbow joint 108 on the first side. The user 100 repeats these movements a plurality of times.

As will be understood by those with skill in the art with reference to this disclosure, the movements utilizing the extension-adduction apparatus 102, or the means for applying tension to the lateral aspect of the user's substantially extended and immobile elbow joint while the user's shoulder joint undergoes an extension-adduction movement 102, can be performed before movements utilizing the flexion-abduction apparatus 112, or the means for applying tension to the medial aspect of the user's substantially extended and immobile elbow joint while the user's shoulder joint undergoes a flexion-abduction movement 112. Further, the user 100 can intersperse movements utilizing the extension-adduction apparatus 102, or the means for applying tension to the lateral aspect of the user's substantially extended and immobile elbow joint while the user's shoulder joint undergoes an extension-adduction movement 102, with movements utilizing the flexion-abduction apparatus 112, or the means for applying tension to the medial aspect of the user's substantially extended and immobile elbow joint while the user's shoulder joint undergoes a flexion-abduction movement 112.

As used in the following claims, limitations containing the word "means" are intended to be interpreted in the United States as "means plus function" language under 35 U.S.C. §112, paragraph 7.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference to their entirety.

What is claimed is:

1. A device for preventing the damage underlying lateral epicondylitis (tennis elbow) or medial epicondylitis (golfer's elbow), or both lateral epicondylitis (tennis elbow) and medial epicondylitis (golfer's elbow), or for treating the damage underlying lateral epicondylitis (tennis elbow) or medial epicondylitis (golfer's elbow), or both lateral epicondylitis (tennis elbow) and medial epicondylitis (golfer's elbow), the device comprising:

a central support having a proximal end, a distal end and an intermediate portion between and connected to the proximal end and the distal end, and where the intermediated portion comprises a rigid rim surrounding a central opening; and one or more than one extension-adduction/flexion-abduction apparatus comprising a proximal end connected to the proximal end of the central support, and a distal end connected to the proximal end of the extension-adduction/flexion-abduction apparatus;

where the proximal end of the extension-adduction-flexion-abduction apparatus comprises a tensioner for applying tension to the distal end of the extension-adduction/flexion-abduction apparatus;

where the distal end of the extension-adduction/flexion-abduction apparatus comprises a lever comprising an "L" shaped structure connected to a rigid strut at or near the bend of the "L" shaped structure, and the level is configured to reversibly pass through the central opening; and where the rigid strut is connected transversely at two points on the rigid rim such that the "L" shaped structure pivots around the rigid strut.

2. The device of claim 1, where the central support has an axial length of between about 25 cm and about 150 cm.

3. The device of claim 1, where the central support comprises a grip.

* * * * *